US009166324B2

(12) United States Patent
Wang et al.

(10) Patent No.: US 9,166,324 B2
(45) **Date of Patent: *Oct. 20, 2015**

(54) COAXIAL CABLE CONNECTOR STRUCTURE

(71) Applicant: JJS COMMUNICATIONS CO., LTD., Taipei (TW)

(72) Inventors: Shou-Ying Wang, Taipei (TW); Tien Shou Yao, Taipei (TW)

(73) Assignee: JJS COMMUNICATIONS CO., LTD., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/518,109

(22) Filed: Oct. 20, 2014

(65) Prior Publication Data

US 2015/0132989 A1 May 14, 2015

Related U.S. Application Data

(63) Continuation-in-part of application No. 13/344,912, filed on Jan. 6, 2012, now Pat. No. 8,961,222.

(30) Foreign Application Priority Data

Oct. 7, 2011 (TW) ..... 100218900 U

(51) Int. Cl.
*H01R 13/24* (2006.01)
*H01R 13/622* (2006.01)
(Continued)

(52) U.S. Cl.
CPC ..... *H01R 13/2421* (2013.01); *H01R 9/05* (2013.01); *H01R 13/622* (2013.01); *H01R 33/975* (2013.01); *H01R 43/00* (2013.01)

(58) Field of Classification Search
CPC ..... H01R 33/975; H01R 9/05
USPC ..... 439/578–585, 63, 733.1, 944, 271, 439/98–99
See application file for complete search history.

(56) References Cited

U.S. PATENT DOCUMENTS 5,166,477 A * 11/1992 Perin et al. ..... 174/74 R
6,716,062 B1 4/2004 Palinkas et al.

(Continued)

OTHER PUBLICATIONS

Official Action for U.S. Appl. No. 13/344,912, mailed Aug. 29, 2013, 7 pages.

(Continued)

*Primary Examiner* — Edwin A. Leon
(74) *Attorney, Agent, or Firm* — Sheridan Ross P.C.

(57) ABSTRACT

A coaxial cable connector structure including a sleeve and an annular nut on the front end of the sleeve is presented, wherein an inner tube is disposed inside the sleeve for connecting the coaxial cable, and a spring is disposed between the inner tube and the inner threads on the annular nut, the spring having a first end positioned proximate the bottom of the annular nut and a second end positioned forward of the front end of the inner tube for the end surface of the connection base towards the annular nut to contact the spring and electrically connect the inner tube when the annular nut is at least partially screwed onto the connection base, so that the coaxial cable connector structure can transmit signals when it is not completely screwed onto the connection base, and provide the effect of vibration suppression from the compressed spring having its two ends abutted against the bottom of the annular nut and the end surface of the connection base by the elastic restoring force when the connection base is completely screwed onto the connection base.

13 Claims, 31 Drawing Sheets

(51) Int. Cl.

| | |
|---|---|
| ***H01R 9/05*** | (2006.01) |
| ***H01R 43/00*** | (2006.01) |
| ***H01R 33/975*** | (2006.01) |

(56) References Cited

U.S. PATENT DOCUMENTS

| | | | | |
|---|---|---|---|---|
| 8,062,063 | B2 | 11/2011 | Malloy et al. | |
| 2008/0102696 | A1 | 5/2008 | Montena | |
| 2008/0311790 | A1 | 12/2008 | Malloy et al. | |
| 2013/0090008 | A1 | 4/2013 | Wang | |
| 2013/0102190 | A1 * | 4/2013 | Chastain et al. | 439/583 |
| 2014/0357120 | A1 * | 12/2014 | Blake et al. | 439/583 |

OTHER PUBLICATIONS

Official Action for U.S. Appl. No. 13/344,912, mailed Nov. 19, 2013, 8 pages.

Notice of Allowance for U.S. Appl. No. 13/344,912, mailed Oct. 17, 2014, 8 pages.

* cited by examiner

COAXIAL CABLE CONNECTOR STRUCTURE

CROSS-REFERENCE TO RELATED APPLICATIONS

The present application is a continuation-in-part application of U.S. application Ser. No. 13/344,912 entitled "Coaxial Cable Connector Structure" filed Jan. 6, 2012, the entire content of which is incorporated herein by reference in its entirety.

BACKGROUND OF THE INVENTION

1. Field of the Invention

The present invention relates to a coaxial cable connector structure, and more particularly to a coaxial cable connector structure having a spring disposed inside the annular nut for electrically connecting the coaxial cable connector and the connection base when the coaxial cable connector is loosened or not completely screwed onto the connection base.

2. Description of Related Art

The coaxial cable is a signal transmission cable widely used in television and network systems, which is fixed on the corresponding connection base of video or network equipment by the coaxial cable connector set at the end. For example, a common F-type coaxial cable connector connects to the coaxial cable through a sleeve, a rotatable annular nut is disposed on the front end of the sleeve, and an inner thread is disposed on the inner surface of the annular nut and a hexagonal outer wall is disposed on its outer surface for rotating to fasten by fingers or clamping tools.

The annular nut needs to be rotated repeatedly to completely connect the abovementioned coaxial cable connector to the connection base, to thereby ensure electrical connection for transmitting signals from the coaxial cable. An incompletely tightened annular nut can result in a disfigured signal. For example, a loose annular nut may move relative to the connection base causing the copper wire inside the cable to move relative to the female connector inside the connection base. In addition, a loose annular nut may also permit outside signals to interact or interfere with the signal carried by inside the cable. However, since the outer contact area of the annular nut is small, it cannot be effectively forced to rotate by fingers, the motion of fastening the annular nut by fingers is time-consuming and labor-intensive. Also, since the connection base is typically disposed on the back side of the abovementioned equipment and the equipment is set in a narrow space, users are compelled to move the equipment to access the connection base for completely fastening the coaxial cable connector. This may cause considerable inconvenience. In view of this, embodiments of the present invention improve the abovementioned defects for transmitting signals when the coaxial cable connector structure is not completely fastened on the connection base, and thereby also increase convenience in use.

SUMMARY OF THE INVENTION

The object of the present invention is to provide a coaxial cable connector structure, wherein a spring is disposed on the bottom of the annular nut for the end surface of the connection base towards the annular nut to contact the spring and electrically connect the inner tube of the sleeve when the connection base is not completely screwed into the inner thread of the annular nut.

In order to achieve the abovementioned object, the coaxial cable connector structure according to embodiments of the present invention includes a sleeve and an annular nut disposed on the front end of the sleeve, and an inner tube or ferrule is disposed inside the sleeve for connecting the coaxial cable, and the annular nut has an inner thread on its inner surface for combining with a connection base having an outer thread, wherein a spring is disposed on the bottom of the annular nut for the end surface of the connection base towards the annular nut to contact the spring and electrically connect the inner tube when the connection base is screwed into the inner thread of the annular nut.

When implemented, in at least one embodiment, a flange part is disposed on the front end of the inner tube for engaging the bottom of the annular nut, and a gap is formed between the flange part and the annular nut for receiving the spring inside. When implemented, the flange part may also have an indentation thereon for receiving an O-ring within it.

In another embodiment, the inner tube or ferrule includes a radially extending projection adapted to interconnect one end of the spring to the inner tube.

In another embodiment, the ferrule or inner tube has a tapered cross-section formed by decreasing a diameter of the ferrule from the flange part to the front end of the inner tube such that a forward most portion of the ferrule has a smaller outside diameter than a rearward portion of the ferrule.

When implemented in some embodiments, one end of the spring is fixed on the bottom of the annular nut.

When implemented in some embodiments, the spring is engaged on the inner thread of the annular nut.

When implemented in some embodiments, the outer diameter of the spring is smaller than or equal to the inner diameter of the annular nut.

When implemented in some embodiments, the spring is a metal spring with the electric conductivity.

In another embodiment, the spring has at least one generally flat surface or a generally D-shaped cross-sectional profile on at least one end to increase surface contact and electrical connectivity at least between the spring and the front face of the base connector.

In another embodiment, the spring has at least one generally flat surface or a generally D-shaped cross sectional profile that is substantially consistent along the length of the spring.

When implemented, the thickness of the flange part is greater than or equal to the height of the spring after being compressed.

When implemented, a flange part is disposed on the front end of the inner tube for engaging the bottom of the annular nut, and a groove is disposed on the flange part for placing and receiving the spring inside.

When implemented, the depth of the groove is greater than or equal to the height of the spring after being compressed.

It is one aspect of the present invention to provide a coaxial cable connector structure. The coaxial cable connector structure generally comprises a sleeve and an annular nut disposed on the front end of the sleeve. An inner tube or ferrule is disposed inside the sleeve for connecting the coaxial cable. The annular nut has an inner thread on its inner surface for combining with a connection base having an outer thread. The inner tube has a front end with a front surface toward the connection base and a flange part disposed inwardly of the front end of the inner tube. The inner tube has an outer surface of a diameter less than the diameter of the inner thread of the annular nut such that a gap is formed between the outer surface of the inner tube and the inner threads of the annular nut. The coaxial cable connector structure also includes a coil spring having a first end and a second end. The first end of the coil spring is interconnected to a retaining structure formed on the inner tube such that the first end of the coil spring is disposed within the gap. The second end of the coil spring extends forward of the front surface of the front end of the inner tube to contact and electrically connect the inner tube with the front face of the connection base when the connection base is partially screwed into the inner thread of the annular nut. When the connection base is fully screwed into the inner thread of the annular nut the end surface of the connection base will contact the front surface of the front end of the inner tube and the coil spring will be fully compressed in the gap between the outer surface of the inner tube and the inner surface of the annular nut and also will remain in contact with the end surface of the connection base.

In one embodiment, the retaining structure formed on the ferrule comprises at least one of an indentation and a projection extending radially from the outer surface of the ferrule for the purpose of capturing a first end of the coil spring. In another embodiment, the indentation has a cross-sectional shape substantially the same as a cross-sectional shape of the coil spring. In still another embodiment, the coil spring has at least one generally flat surface adapted to contact the end surface of the connection base. In another embodiment, the at least one generally flat surface is formed along a chord of the coil spring. In still another embodiment, the at least one generally flat surface is formed along the diameter of the coil spring. In one embodiment, the coil spring has a substantially uniform cross-sectional shape along a length of the coil spring. In still another embodiment, at least one coil at one end of the coil spring has an inner coil diameter that is less than the diameter of the outer surface of the ferrule. In yet another embodiment, a diameter of the outer surface of the inner tube proximate the flange part is greater than a diameter of the outer surface of a forward end of the inner tube such that a tapered gap is formed between the outer surface of the inner tube and the inner threads of the annular nut.

In accordance with another aspect of the present invention, a novel method of electrically connecting a coaxial cable to a connection base with a coaxial cable connector structure is provided. This includes, but is not limited to, a method generally comprising: (1) providing an coaxial cable connector structure comprising: a sleeve; an annular nut disposed on the front end of the sleeve, the annular nut having an inner thread on its inner surface; an inner tube disposed inside the sleeve, the inner tube having a flange part and a front end with a front surface toward the connection base, the inner tube having outer surface of a diameter less than a diameter of the inner thread of the annular nut such that a gap is formed between the outer surface of the inner tube and the inner threads of the annular nut; a coil spring having a first end and a second end, the first end of the coil spring interconnected to a retaining structure formed on the inner tube, and the coil spring having at least one generally flat surface adapted to contact one or more of an end surface of the connection base and the outer surface of the inner tube; (2) interconnecting the coaxial cable to the sleeve of the coaxial cable connector structure; (3) placing the annular nut in contact with an outer thread of the connection base; (4) rotating the annular nut to at least partially screw the connection base into the inner thread of the annular nut, wherein the second end of the coil spring contacts the end surface of the connection base and electrically connects the inner tube to the connection base; and (5) rotating the annular nut to fully screw the connection base into the inner thread of the annular nut, wherein the end surface of the connection base contacts the front surface of the front end of the inner tube, and wherein the coil spring is fully compressed on the inner tube in the gap and the coil spring contacts the end surface of the connection base and the outer surface of the inner tube.

In order to further understand the present invention, the prefer embodiments are described with figures and numbers as follow to illustrate the practical construction and the achieved effects of the present invention.

Figure 1:
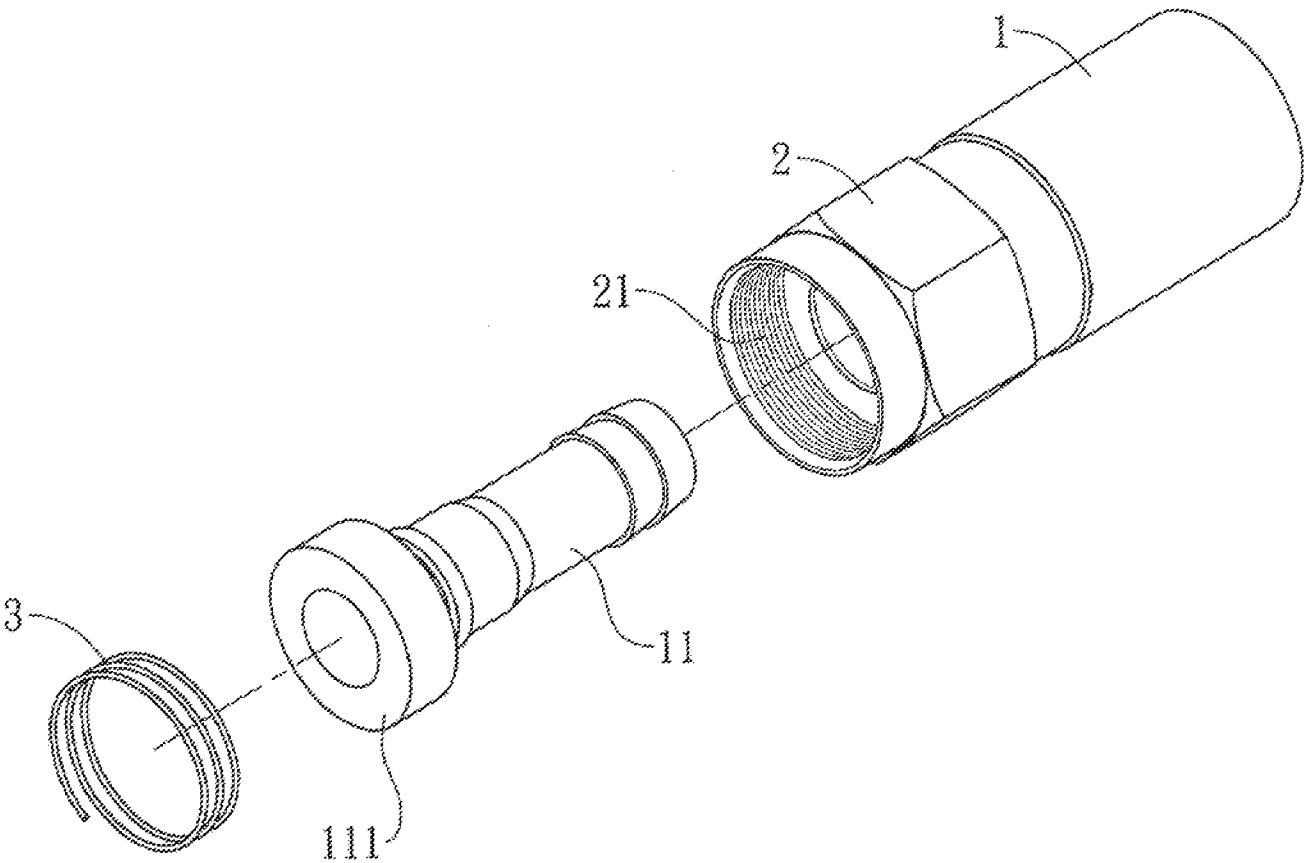
FIG. 1 is a schematic combination diagram of a coaxial cable connector structure according to the first embodiment of the present invention.

To assist in the understanding of one embodiment of the present invention the following list of components and associated numbering found in the drawings is provided herein:

| Number | Component |
|---|---|
| 1 | Sleeve |
| 2 | Annular nut |
| 3 | Spring |

-continued

| Number | Component |
|---|---|
| 4 | Coaxial cable |
| 5 | Connection base |
| 6 | O-ring |
| 7 | Cylindrical structure |
| 11 | Inner tube |
| 20 | Gap |
| 21 | Inner thread of annular nut |
| 31 | First end of spring |
| 32 | Second end of spring |
| 33 | Flat surface of the spring |
| 34 | Diameter of spring |
| 35 | Range of flat surface |
| 51 | Outer thread of connection base |
| 52 | Front face of connection base |
| 71 | Outer cylindrical body |
| 72 | Tabs |
| 73 | Inner surface |
| 74 | Gap |
| 75 | Outer surface of tab |
| 76 | Front surface |
| 77 | Lip |
| 111 | Flange of tube |
| 112 | Groove on flange part |
| 113 | Indentation |
| 114 | Front portion |
| 115 | Front surface of inner tube |
| 116 | Projection of ferrule |
| 117 | Indentation of ferrule |
| 118 | Groove |
| 119 | End-wall |

DETAILED DESCRIPTION OF THE INVENTION

Figure 2:
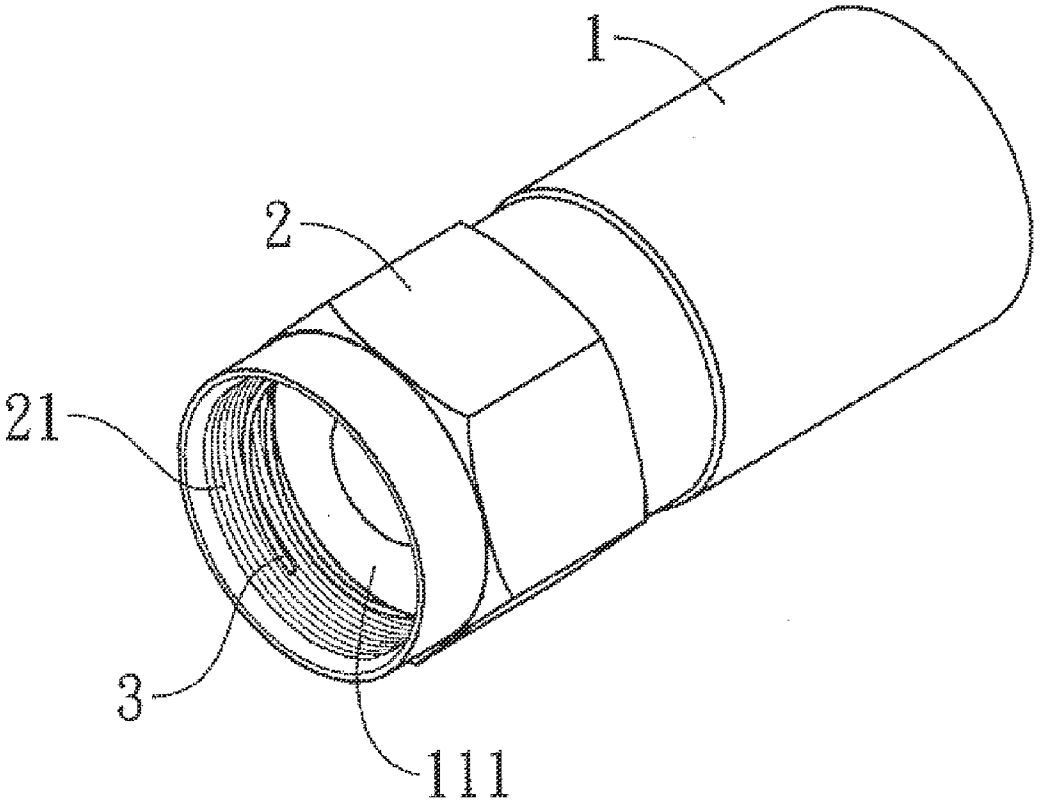
FIG. 2 is a three-dimension diagram of the embodiment in FIG. 1.
Figure 3:
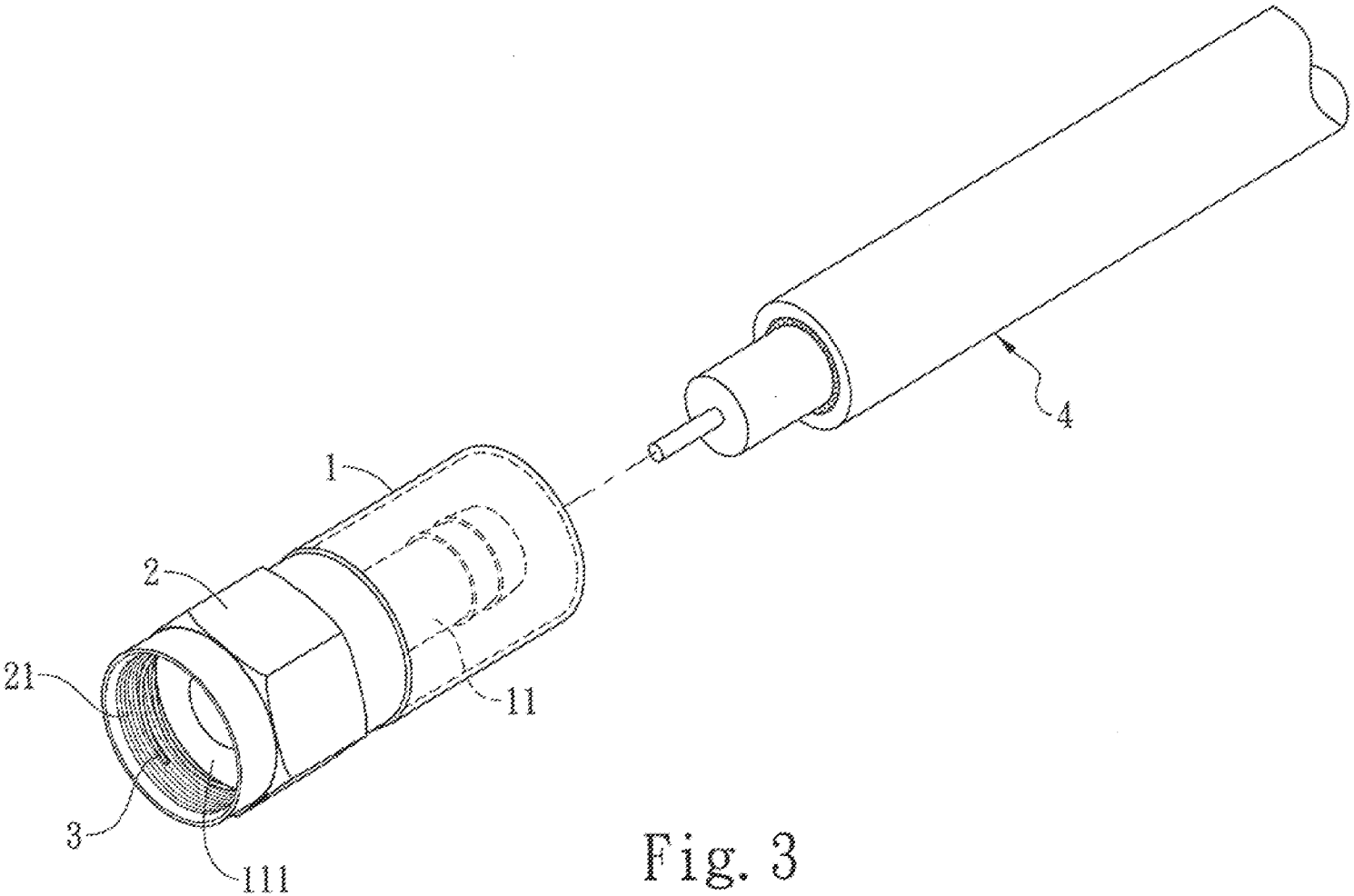
FIG. 3 is a schematic combination diagram of the embodiment in FIG. 1 when being combined with the coaxial cable.
Figure 4:
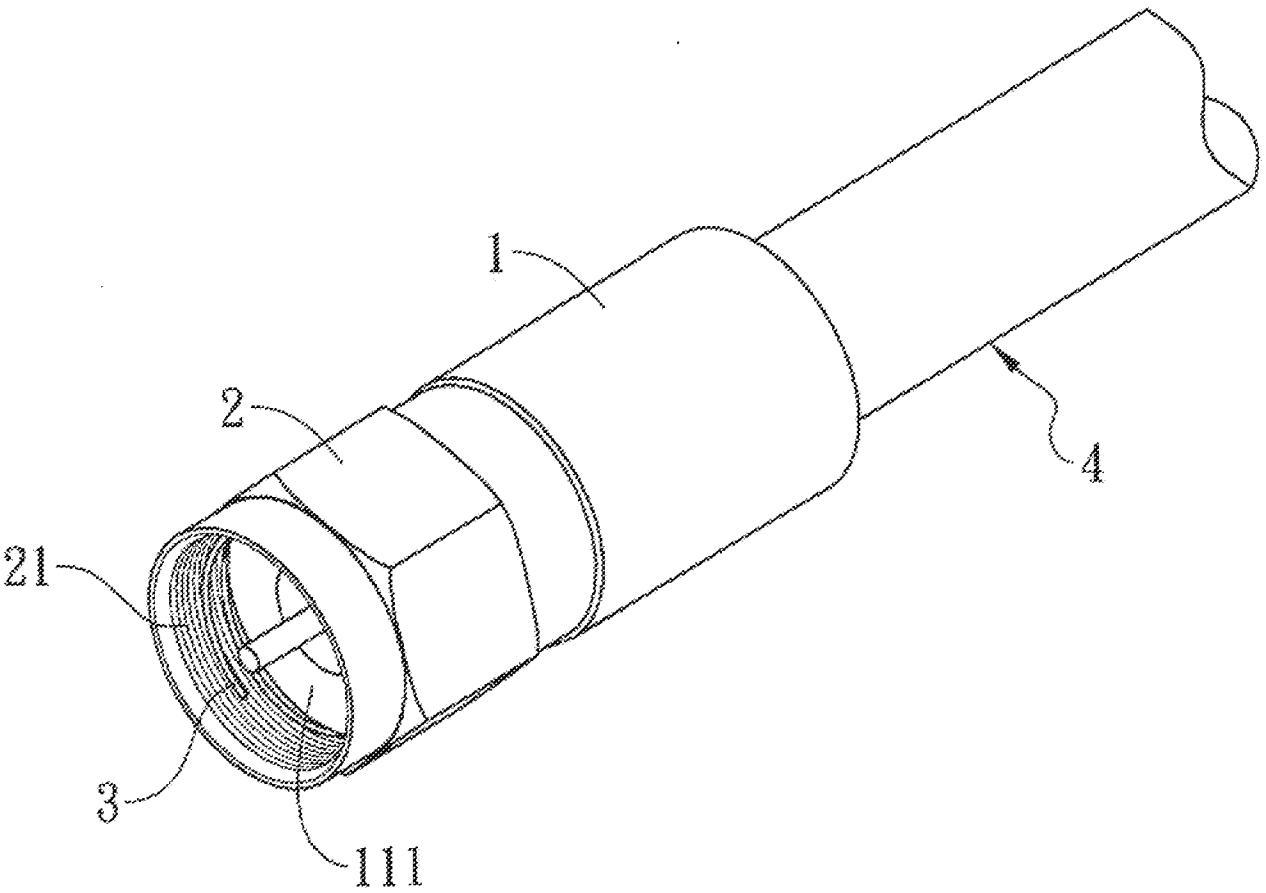
FIG. 4 is a three-dimension diagram of the embodiment in FIG. 1 after being combined with the coaxial cable.

Please refer to FIG. 1 and FIG. 2, which are the first embodiment of the coaxial cable connector structure of the present invention, and includes a sleeve 1, an annular nut 2 disposed on the front end of the sleeve 1, and a spring 3, wherein an inner tube 11 is disposed inside the sleeve 1 for connecting the coaxial cable 4 (as shown in FIG. 3 and FIG. 4), and a flange part 111 disposed on the front end of the inner tube 11 is combined with the bottom inside the annular nut 2 for spacing the annular nut 2 on the front end of the sleeve 1, and a gap 20 is formed between the flange part 111 and the annular nut 2. The annular nut 2 has an inner thread 21 on its inner surface for connecting a connection base 5 having an outer thread 51 (as shown in FIG. 6A).

Figure 5:
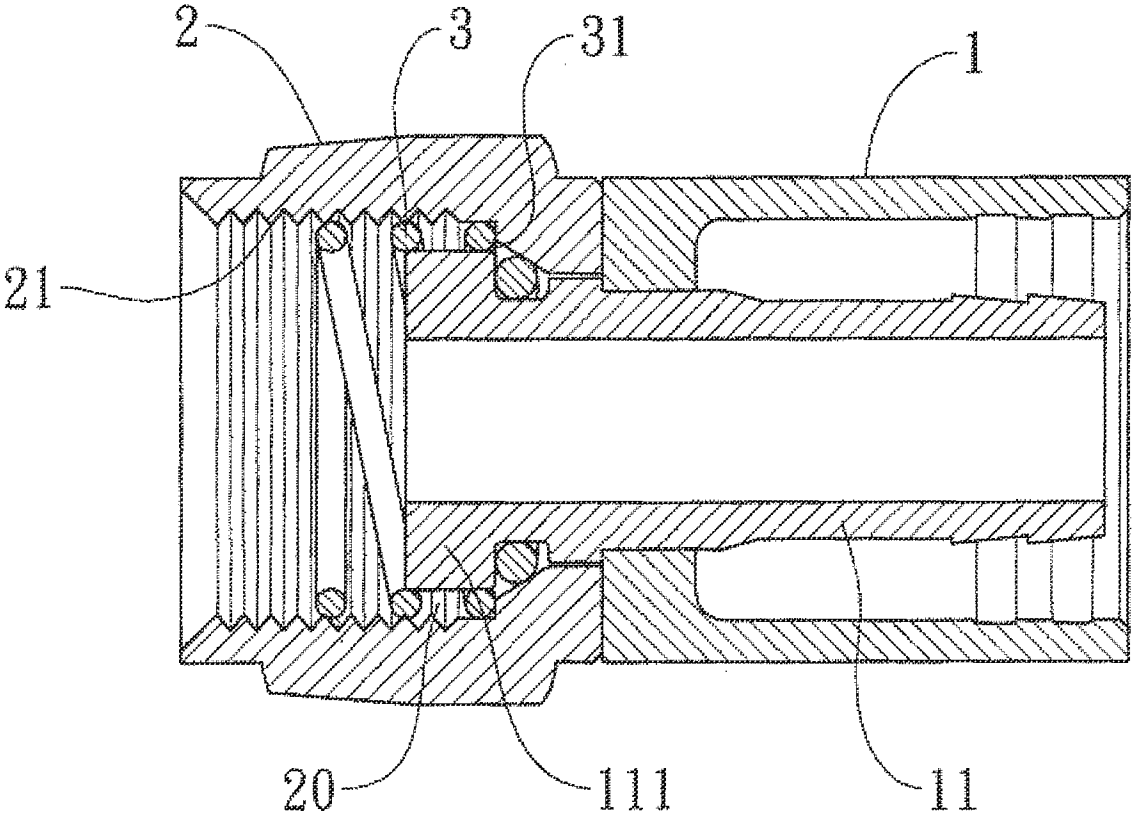
FIG. 5 is a schematic section diagram of the embodiment in FIG. 1.

The spring 3 is made of electric conductive metal material, and disposed inside the gap 20 between the flange part 111 and the annular nut 2 in the annular nut 2 (as shown in FIG. 5). The bottom end 31 of the spring 3 is fixed on the bottom of the annular nut 2, and the outer diameter of the spring 3 is slightly smaller than the inner diameter of the annular nut 2 for engaging the inner thread 21 of the annular nut 2. The outer diameter of the spring 2 may be designed as equal to the inner diameter of the annular nut 2.

Figure 6A:
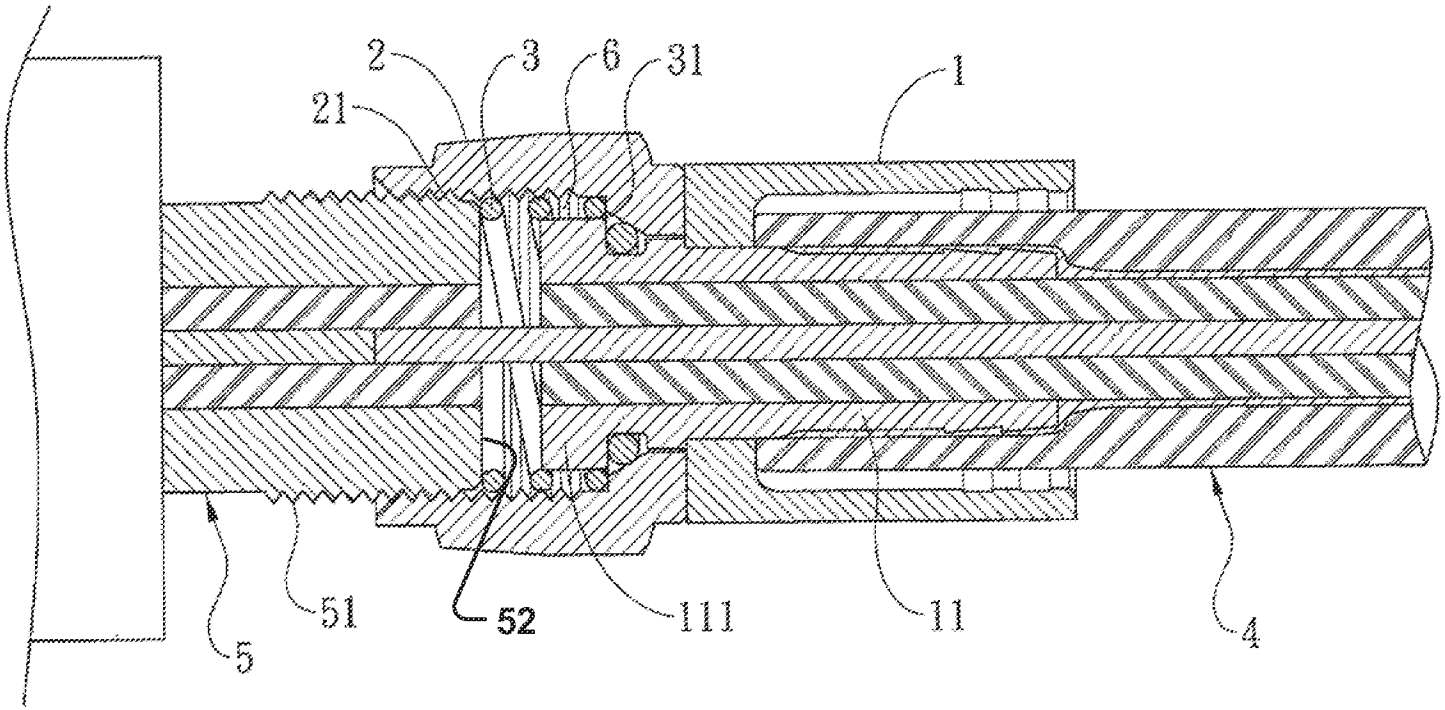
FIG. 6A is a schematic section diagram of the embodiment in FIG. 1 when being combined with the coaxial cable.
Figure 6B:
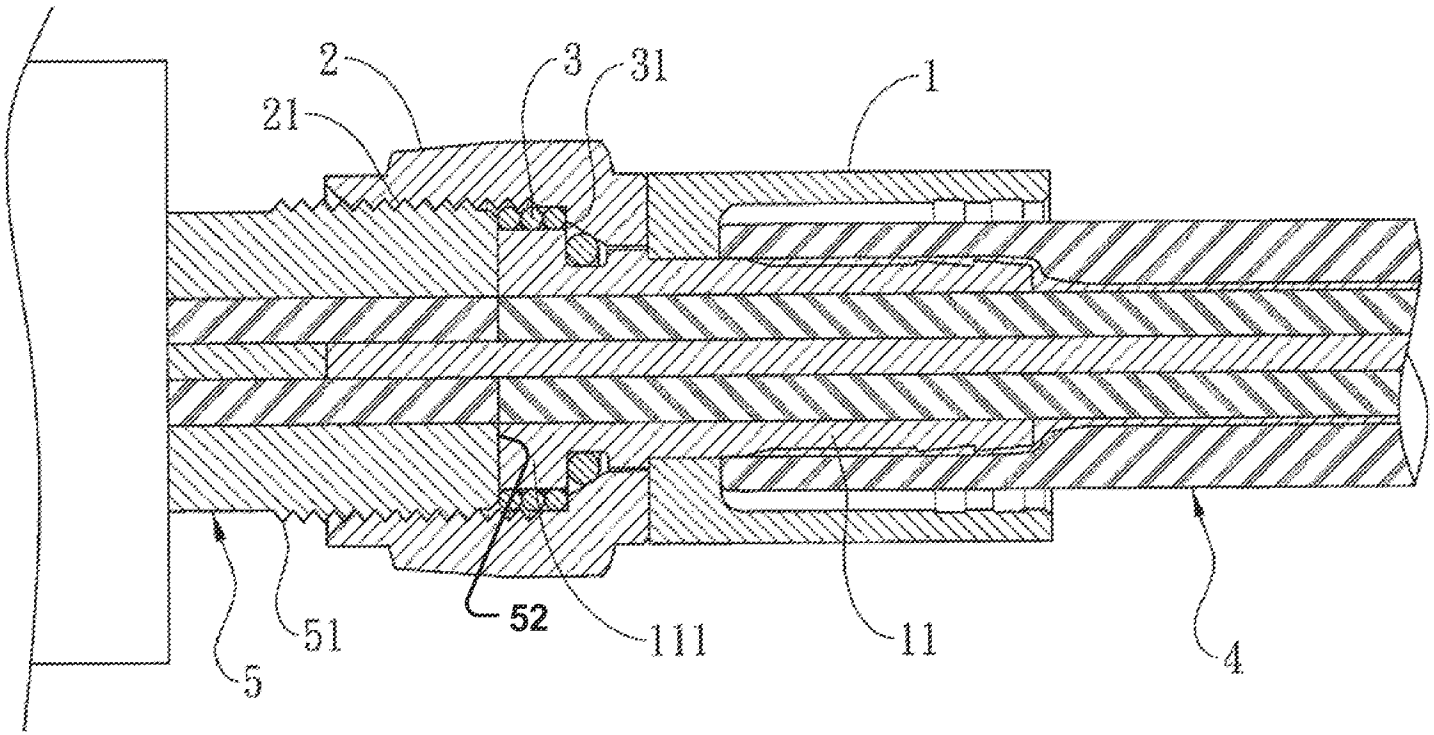
FIG. 6B is a schematic section diagram of the embodiment in FIG. 1 after being combined with the coaxial cable.

When implemented, please refer to FIG. 6A and FIG. 6B, according to the present invention, when the connection base 5 is screwed into the annular nut 2, it allows the end surface 52 of the connection base 5 towards the annular nut 2 to contact the spring 3 and electrically connect to the inner tube 11 of the annular nut 2 via the spring 3. Besides, the thickness of the flange part 111 is greater than or equal to the height of the spring 3 after being compressed for completely placing and receiving the compressed spring 3 in the gap 20 when the connection base 5 is completely screwed into the annular nut 2 and the end surface 52 of the connection base 5 towards the annular nut 2 contacts the upper surface of the inner tube 11 to electrically connect for transmitting signals.

Figure 7:
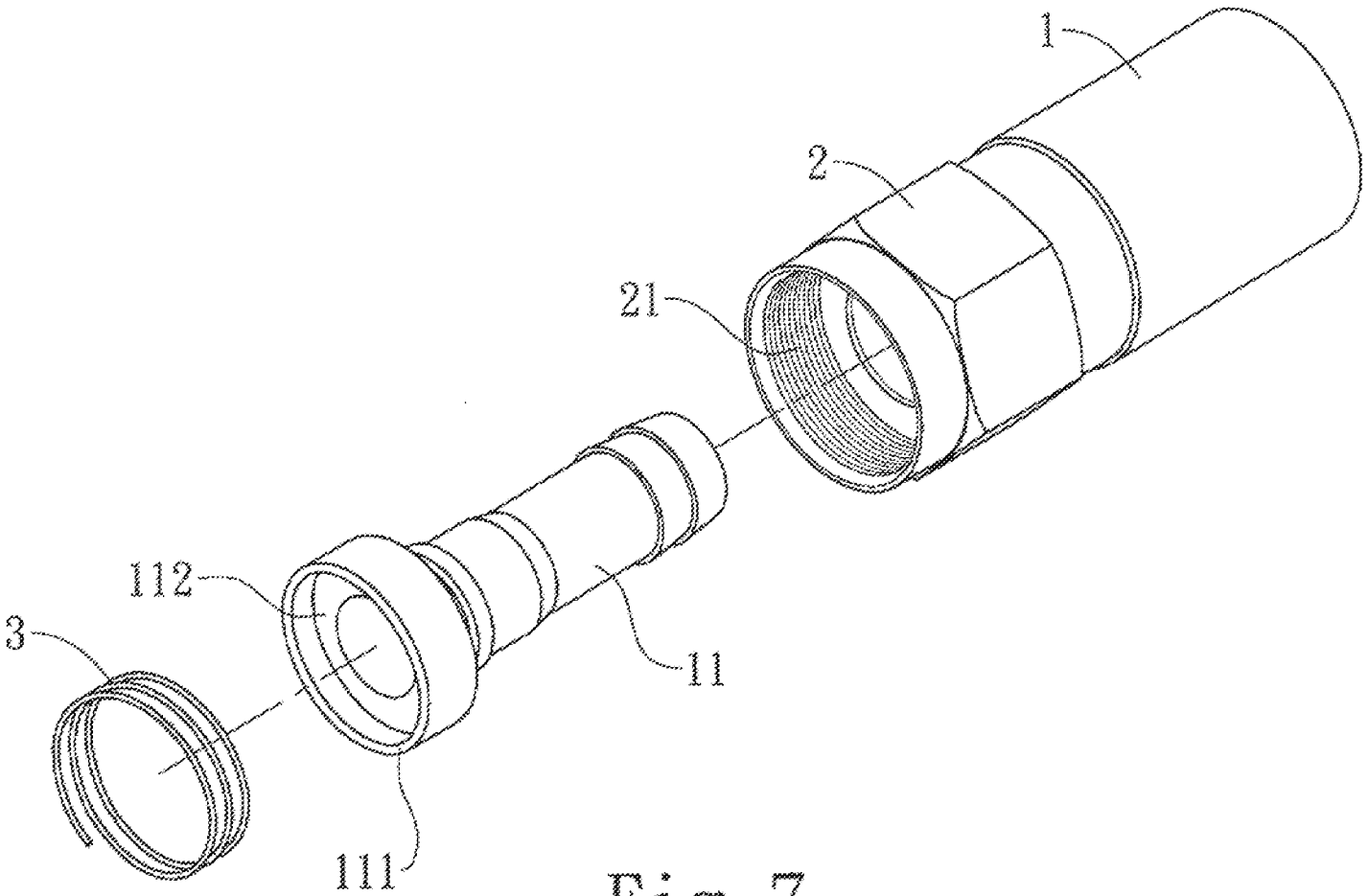
FIG. 7 is a three-dimension diagram of a coaxial cable connector structure according to the second embodiment of the present invention.
Figure 8A:
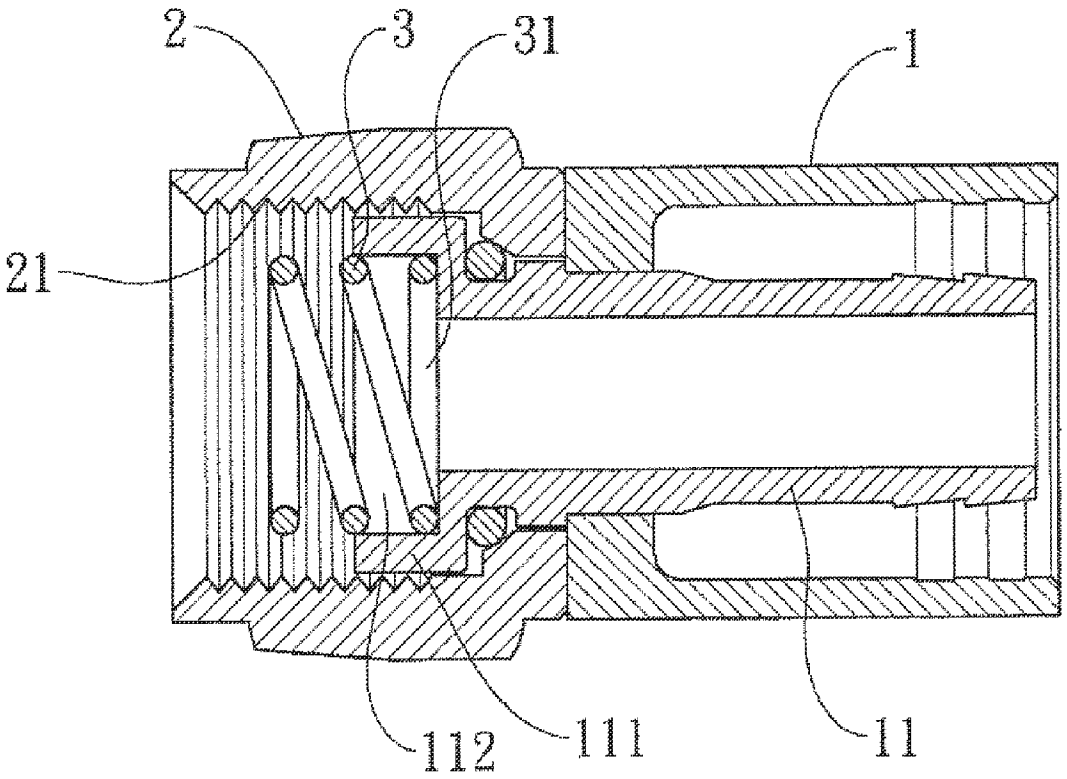
FIG. 8A is a schematic section diagram of the embodiment in FIG. 7 after being combined with the coaxial cable.

Please refer to FIG. 7 and FIG. 8A, which is the second embodiment of the coaxial cable connector structure according to the present invention, and using the structure of the abovementioned first embodiment as its base.

A flange part 111 is disposed on the front end of the inner tube 11 on the bottom of the annular nut 2 for engaging the bottom of the annular nut 2. A groove 112 is disposed on the flange part 111, and the depth of the groove 112 is greater than or equal to the height of the spring 3 after being compressed for completely placing and receiving the spring 3 after being compressed inside.

Figure 8C:
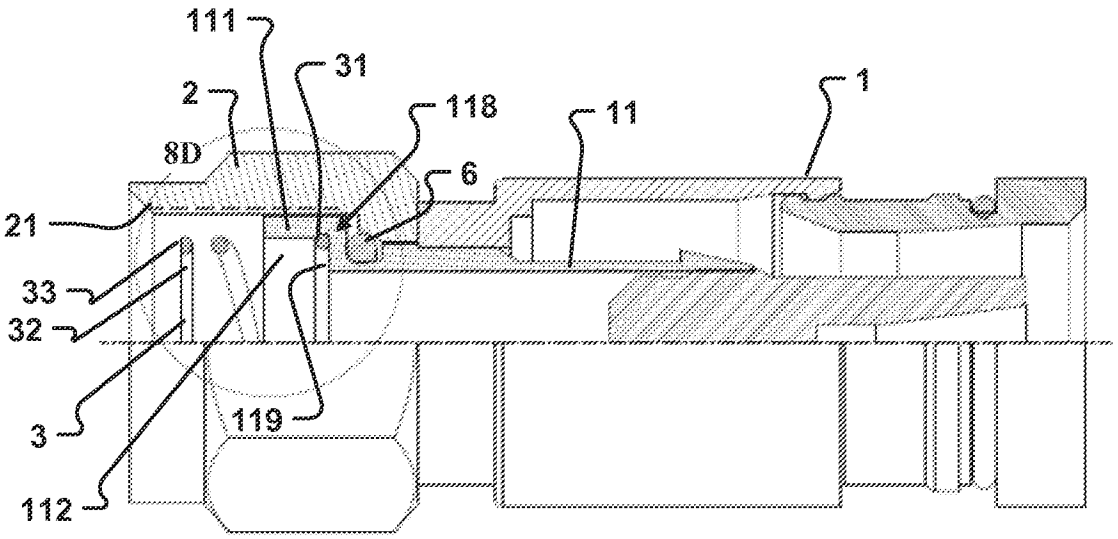
FIG. 8C is a partial cross-sectional elevation view of the coaxial cable connector structure of FIG. 8B taken along line 8C.
Figure 8B:
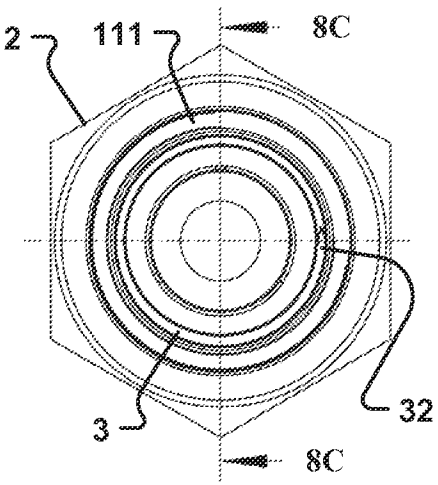
FIG. 8B is a front elevation view of the coaxial cable connector structure of FIG. 7 with a modified inner tube according to another embodiment of the present invention.
Figure 8D:
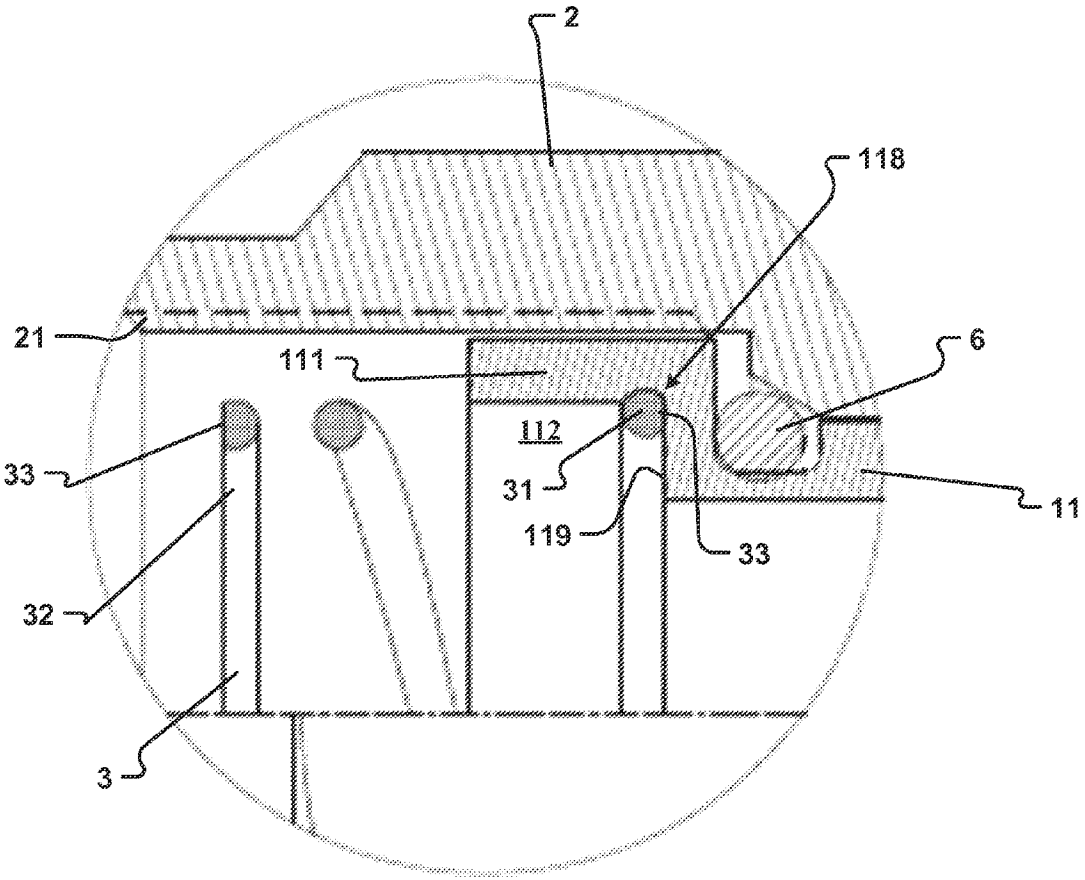
FIG. 8D is a detailed partial cross-sectional elevation view of a portion of the coaxial cable connector structure of FIG. 8C taken along circle 8D.

Referring now to FIGS. 8B-8D, the second embodiment of the coaxial cable connector structure may optionally include a recess or groove 118 formed in at least a portion of the circumference of an interior surface of the inner tube 11 within the groove 112. The groove 118 facilitates securing a first end 31 of the spring 3 to the inner tube 11 by an improved frictional engagement. The groove 118 also increases the surface contact area between the spring 3 and the inner tube 11 and improves the electrical connection between the inner tube 11 and the spring 3. In turn, this also improves the electrical connection between the connection base 5 and the inner tube 11. In one embodiment, the groove 118 has a cross-sectional shape that is substantially equal to the surface shape of the spring 3 to further increase the surface contact between the spring 3 and the inner tube 11.

The spring 3 may optionally have at least one generally flat surface 33 to increase the surface area of the spring 3 that contacts surface of the inner tube 11 and/or the end surface 52 of the connection base 5 as will be discussed in more detail hereinafter. In the embodiment of the present invention illustrated in FIGS. 8B-8D, two flat surfaces 33 have been formed on the end portions of the spring 3 proximate to both the first end 31 and the second end 32 of the spring 3. The flat surface 33 of the second end 32 faces and contacts at least a portion of the end surface 52 of the connection base 5. The flat surface 33 of the first end faces and contacts an inner end-wall 119 of the groove 112.

Figure 9:
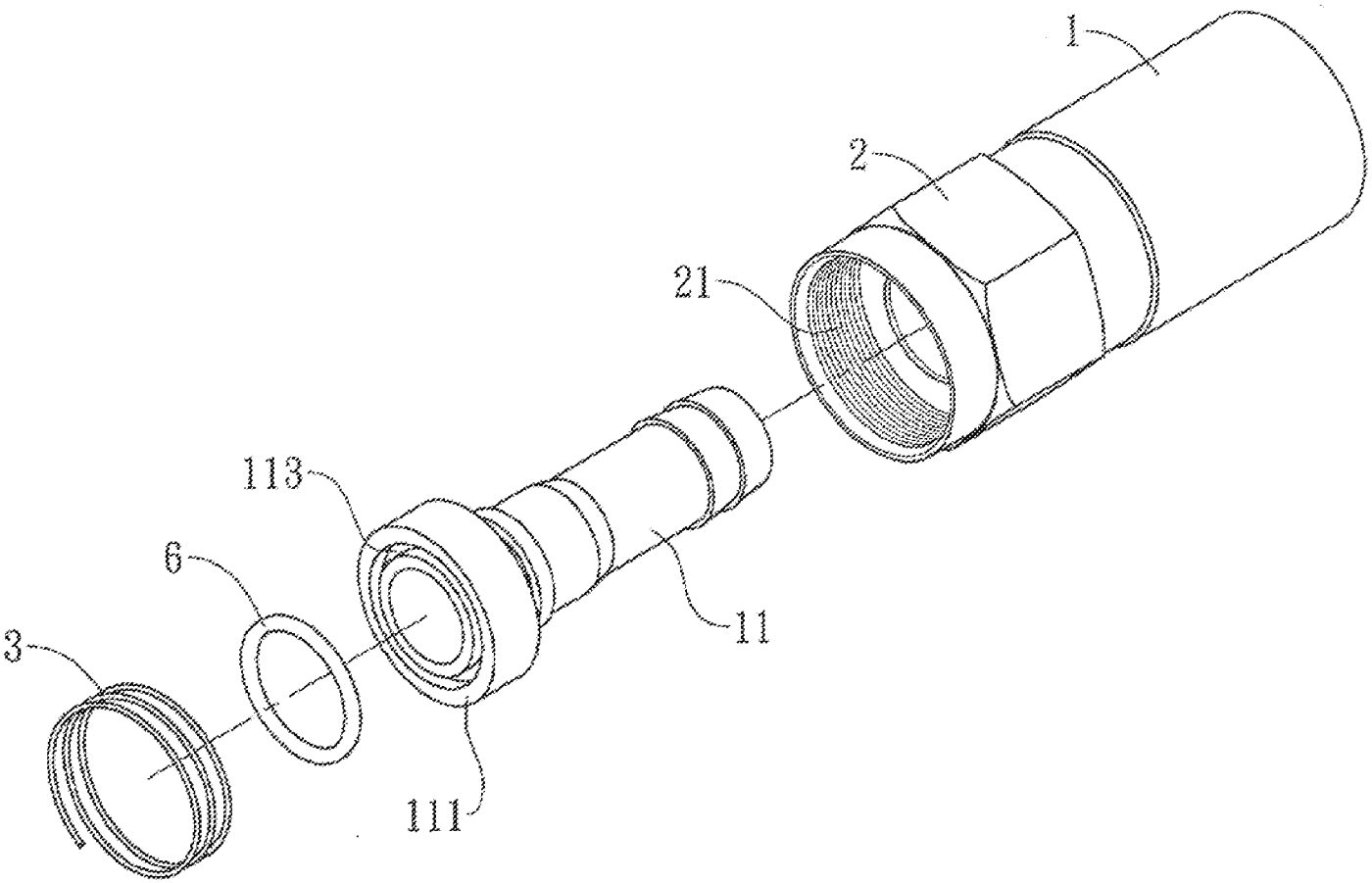
FIG. 9 is a three-dimension diagram of a coaxial cable connector structure according to the third embodiment of the present invention.
Figure 10A:
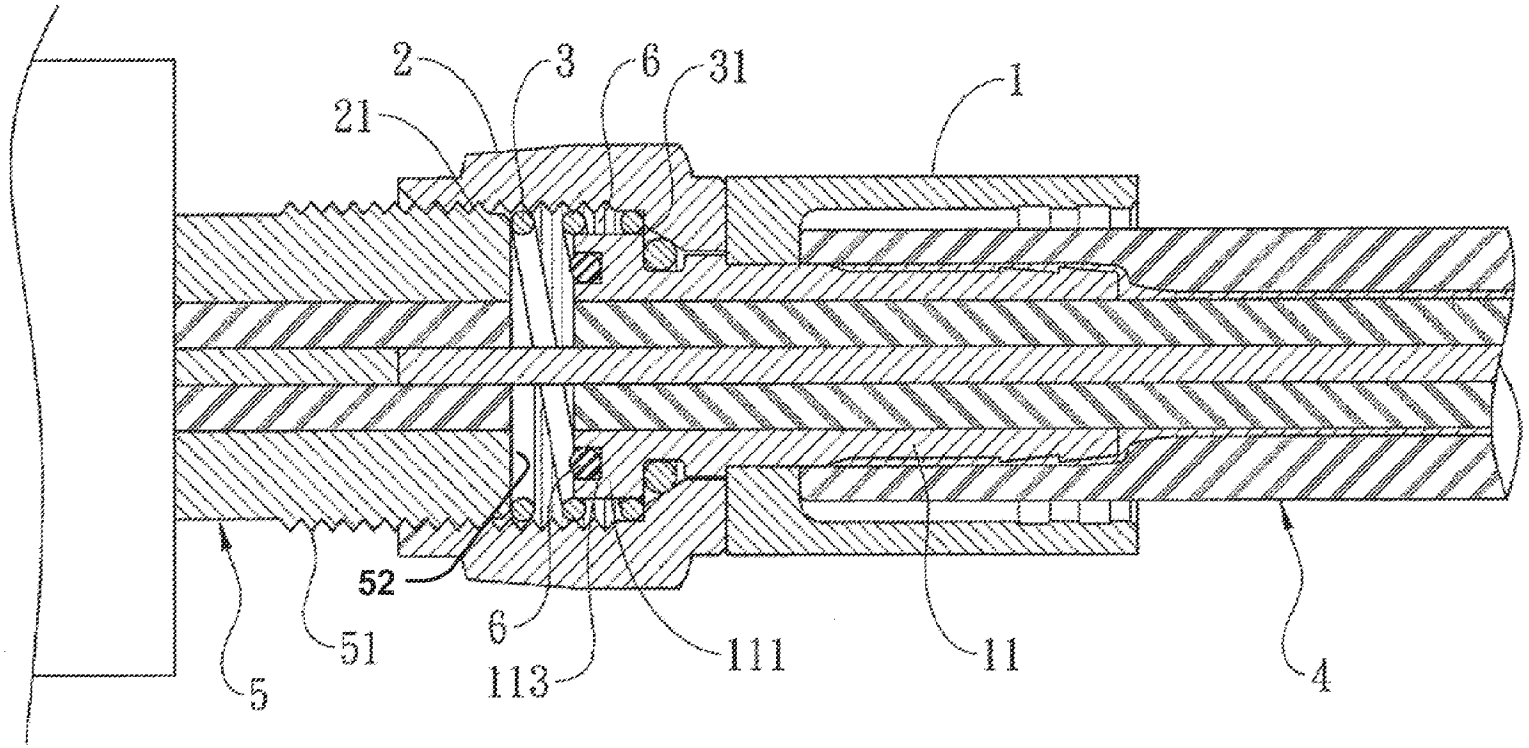
FIG. 10A is a schematic section diagram of the embodiment in FIG. 9 when the connection base is screwed into the annular nut.
Figure 10B:
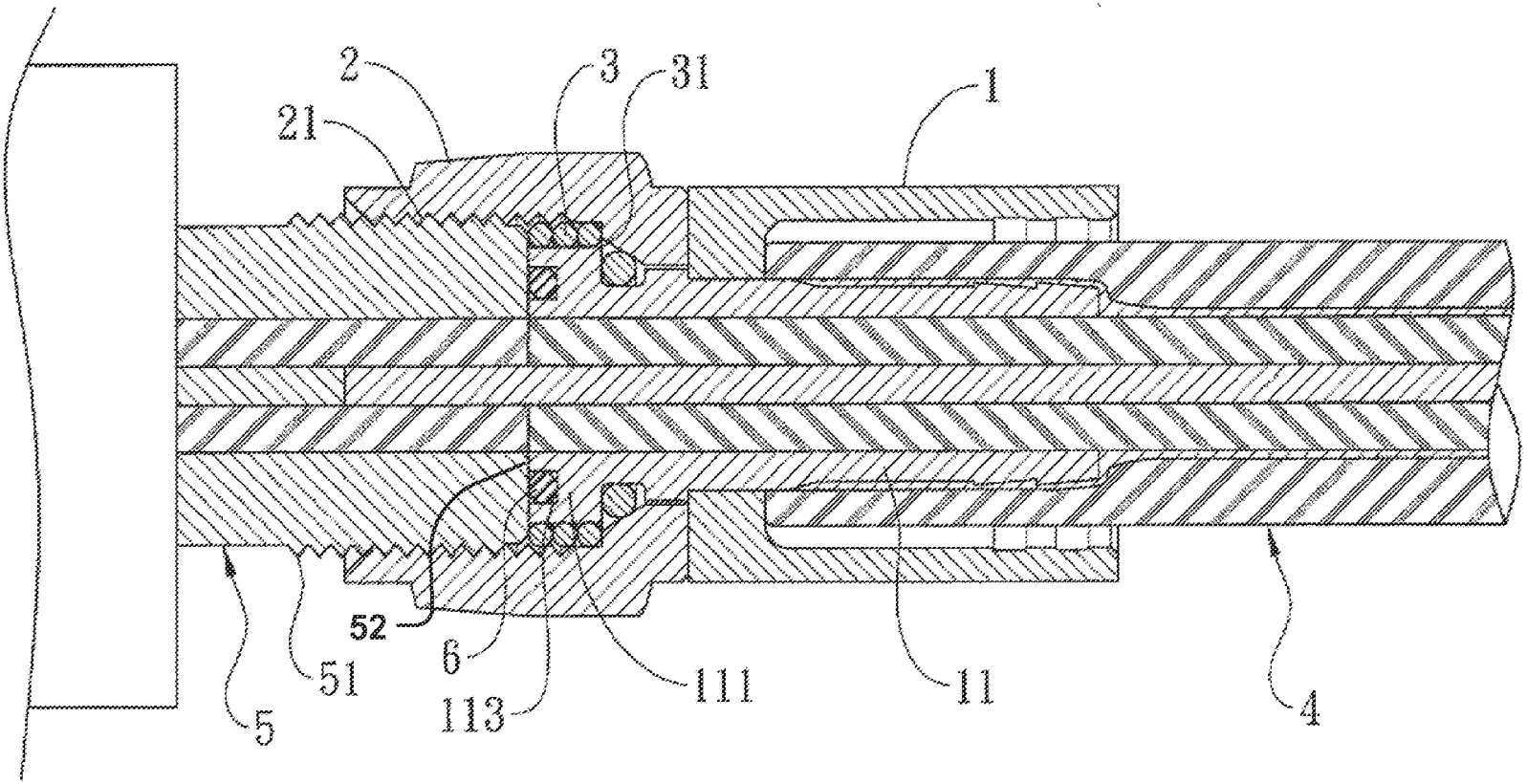
FIG. 10B is a schematic section diagram of the embodiment in FIG. 9 when the connection base is totally screwed into the annular nut.
Figure 11B:
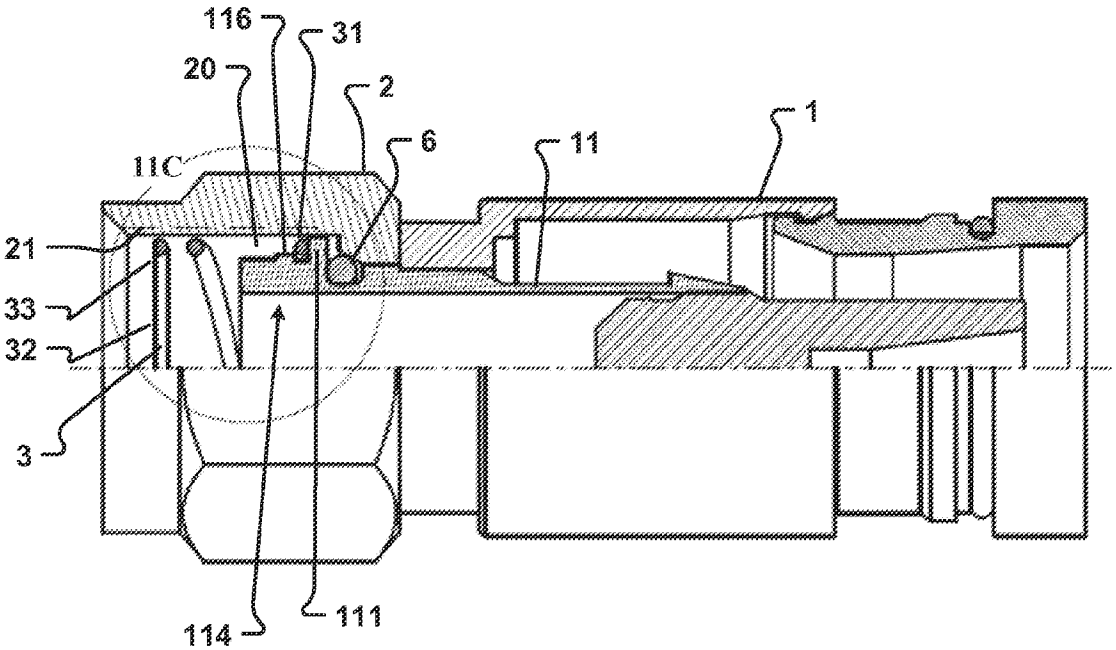
FIG. 11B is a partial cross-sectional elevation view of the coaxial cable connector structure of FIG. 11A taken along line 11B.
Figure 11A:
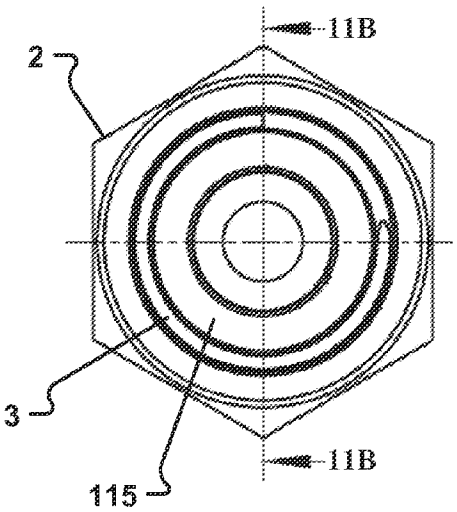
FIG. 11A is a front elevation view of a coaxial cable connector structure according to a fourth embodiment of the present invention.
Figure 11D:
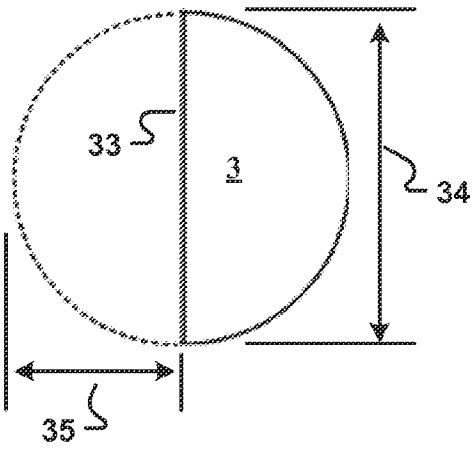
FIG. 11D is a detailed cross-sectional elevation view of a portion of a spring according to an embodiment of the present invention.
Figure 11C:
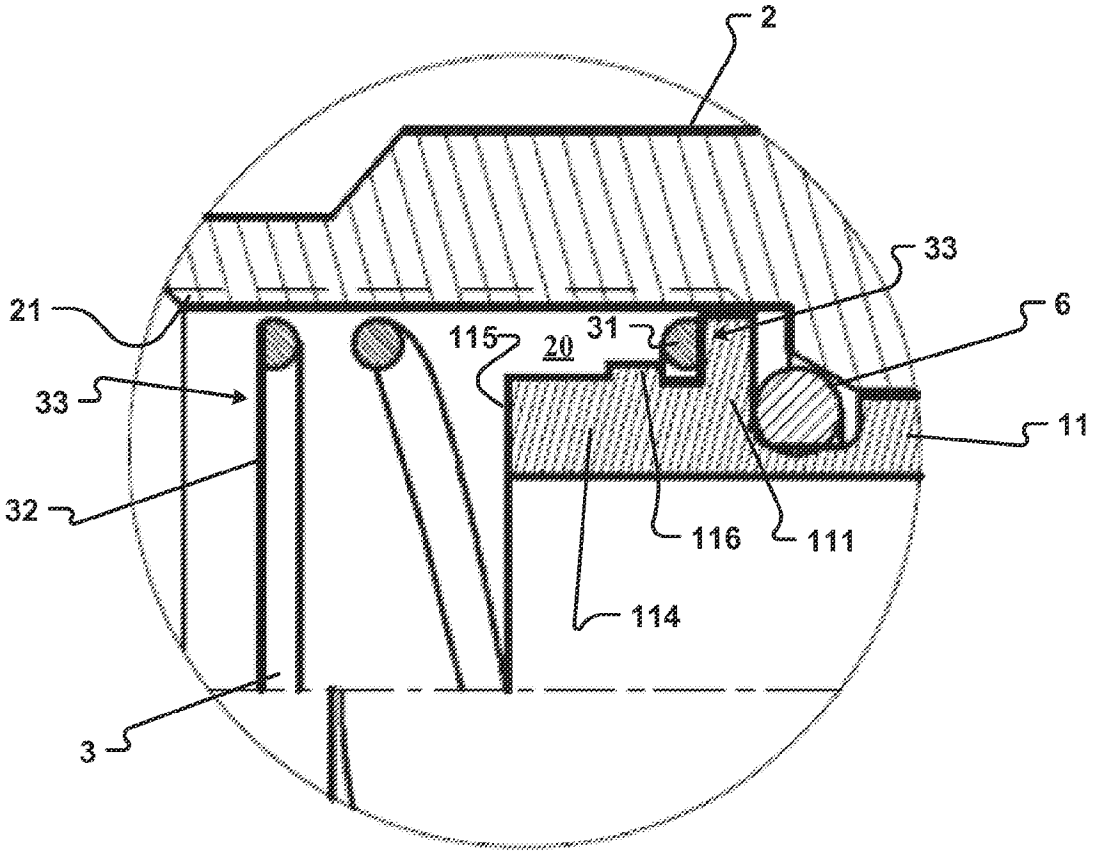
FIG. 11C is a detailed cross-sectional elevation view of a portion of the coaxial cable connector structure taken along circle 11C of FIG. 11B.

Please refer to FIG. 9, which is the third embodiment of the coaxial cable connector structure according to the present invention, and using the structure of the abovementioned first embodiment as its base. An indentation 113 is disposed on the flange part 111 for receiving an O-ring 6 within the indentation 113. The cross-sectional diameter of the O-ring 6 is lightly larger than the depth of the indentation 113 (as shown in FIG. 10), so that when the connection base 5 is totally screwed into the annular nut 2 and pressing the O-ring 6 with the end surface 52 of the connection base 5 towards the annular nut 2, a sealing barrier is formed between the end surface 52 of the connection base 5 and the flange part 111 to prevent water from flowing into the central copper conductor of the coaxial cable 4.

Referring now to FIGS. 11A-11D, a fourth embodiment of the coaxial cable connector structure of the present invention is illustrated. The coaxial cable connector structure includes at least a sleeve 1, an annular nut 2 disposed on the front end of the sleeve 1, a spring 3, and an O-ring 6. The annular nut 2 has an inner thread 21 on its inner surface for connecting a connection base 5.

An inner tube or ferrule 11 is disposed inside the sleeve 1 for connecting the coaxial cable 4. The inner tube 11 has a front portion 114 disposed in front of a flange 111. The front portion 114 has an outer diameter that is less than the outer diameter of the flange 111. A front surface 115 of the inner tube 11 is adapted to directly contact the end surface 52 of the connection base 5 when the annular nut 2 is fully screwed into the connection base 5.

A gap 20 is formed between at least the front portion 114 of the inner tube 11 and the inner thread 21 of the annular nut 2. The gap 20 allows the annular nut 2 to rotate and thus enables the annular nut 2 to be easily tightened. A radially extending annular projection 116 is formed on the front portion 114 of the inner tube 11. The projection 116 is adapted to interconnect a first end 31 of the spring 3 to the inner tube 11. The projection 116 also increases the surface contact area between the spring 3 and the inner tube 11. This enhances the electrical connection between the connection base 5 and the inner tube 11 once the opposite or second end 32 of the spring 3 contacts the front face 52 of the connection base 5.

The spring 3 is made of electric conductive metal material and has a coil diameter predetermined to fit inside the gap 20 between the front portion 114 of the inner tube 11 and the inner thread 21 in the annular nut 2. When the annular nut 2 is fully secured to the connection base 5 the spring 3 is compressed and the length of the spring 3 is less than or equal to the length of the inner tube front portion 114. The outer diameter of the spring 3 may be designed slightly smaller than the inner diameter of the annular nut 2 or substantially equal to the inner diameter of the annular nut 2. In one embodiment, an inner diameter of the coils of the spring 3 is at least equal to the outer diameter of the inner tube front portion 114. In another embodiment, at least one coil of the spring 3 has an inner coil diameter that is less than an inner coil diameter of the remainder of the spring 3. In yet another embodiment, at least one coil at the first end 31 of the spring 3 has an inner coil diameter greater than an inner coil diameter of the second end 32 of the spring. In this embodiment, the coil diameter of the spring tapers or gradually increases from the second end 32 to the first end 31 of the spring 3. In still another embodiment, at least a portion of the spring 3 can be formed with a smaller coil diameter adapted to interconnect the spring 3 to the ferrule 114.

In one or more embodiments of the present invention, a generally flat surface 33 may be formed on at least a portion of one of the first end 31 and/or second end 32 of the spring 3. The flat surface 33 is adapted to increase the surface area of the spring 3 that contacts surfaces of the inner tube 11 and the end surface 52 of the connection base 5. By increasing the contact area between the spring 3 and the inner tube 11 and the connection base 5, electrical connection between the inner tube 11 and the connection base 5 is improved compared to the electrical connection provided by a round or curved surface of the spring 3.

As the annular nut 2 is screwed into the connection base 5, the spring 3 is compressed on the ferrule front portion 114 between the flange 111 and the end surface 52 of the connection base 5. The flat surface 33 of the second end 32 of the spring 3 faces and contacts at least a portion of the end surface 52 of the connection base 5. In this manner, the spring 3 provides an electrical connection between the inner tube 11 and the connection base 5 when the connection base 5 is not completely screwed into the inner thread 21 of the annular nut 2. However, the spring 3 does not interfere with or prevent the end surface 52 of the connection base 5 from directly contacting the front surface 115 of the inner tube 11 because the spring 3 is not positioned between the end surface 52 of the connection base 5 and the front surface 115 of the inner tube 11. The spring 3 also does not significantly resist compression by the end surface 52 of the connection base 5 and therefore does not naturally increase the amount of rotational force that must be applied to the annular nut 2 to tighten and properly and completely screw the connection base 5 into the inner thread 21. Also, as previously noted, the spring 3 will compress into the gap 20 allowing full contact between the front face 115 of the inner tube 11 and the front face 52 of the connection base 5 while simultaneously maintaining contact between the second end 32 of the spring 3 and the front face 52 of the connection base 5.

The flat surface 33 is formed along any chord of the spring 3 such that the flat surface 33 at the second end 32 is substantially parallel to the end surface 52 of the connection base and the flat surface 33 at the first end 31 is substantially parallel to a surface of the inner tube 11. In one embodiment, a cross-section through of the spring 3 through the flat surface 33 has a generally D-shape. In another embodiment, illustrated in FIG. 11D, the flat surface 33 has a width substantially equal to a cross-sectional diameter 34 of the spring 3 to provide the maximum contact area between the spring 3 and the inner tube 11 and the connection base 5. As will be appreciated by one of skill in the art, the flat surface 33 can have a range 35 of up to one-half of the diameter 34 of the spring 3 or less. In another embodiment, the spring 3 may have two or more flat surfaces 33. The two or more flat surfaces 33 are adapted to increase the contact area between the spring 3 and two or more surfaces of the coaxial cable connector structure. In one embodiment, the spring 3 has two flat surfaces 33 and a cross-section of the spring 3 through the two flat surfaces 33 generally has the shape of a sector of a circle. In one embodiment, the flat surface 33 is formed by flattening at least a portion of the spring 3. In another embodiment, the flat surface 33 is formed by removing at least a portion of the spring 3 by grinding the spring 3 or by any other means known to those of skill in the art. In still another embodiment, the flat surface 33 is formed along the entire length of the spring 3 such that the spring 3 has a substantially uniform cross-section along the length of the spring 3.

Figure 12B:
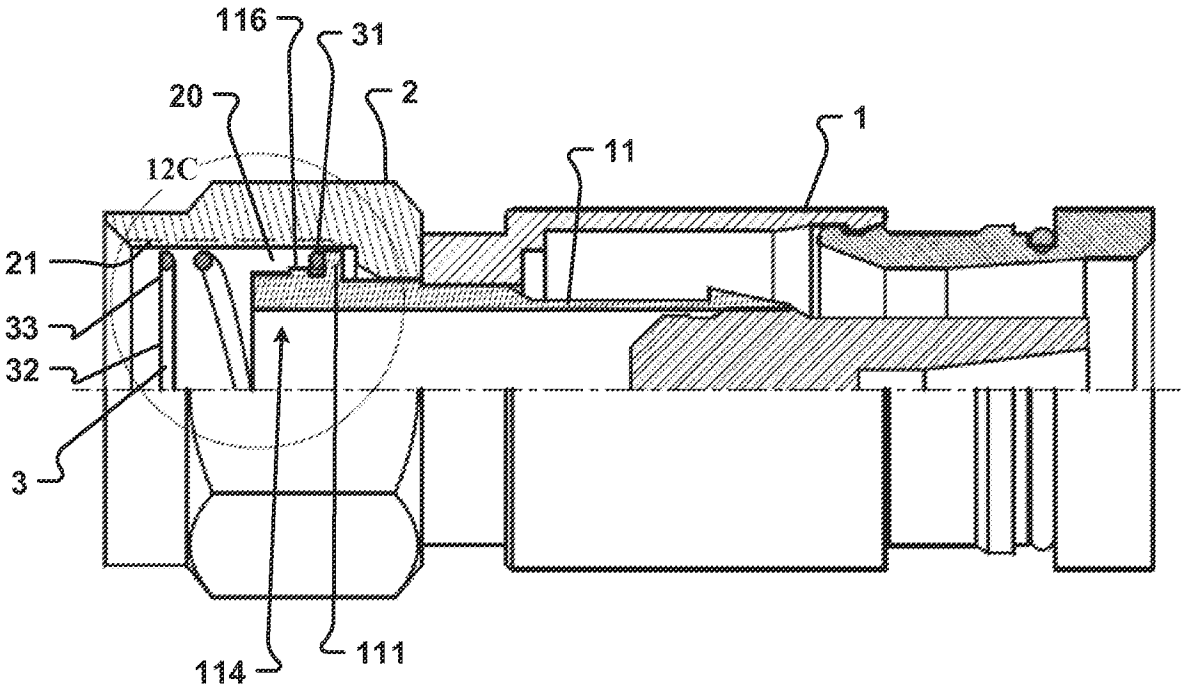
FIG. 12B is a partial cross-sectional elevation view of the coaxial cable connector structure of FIG. 12A taken along line 12B.
Figure 12A:
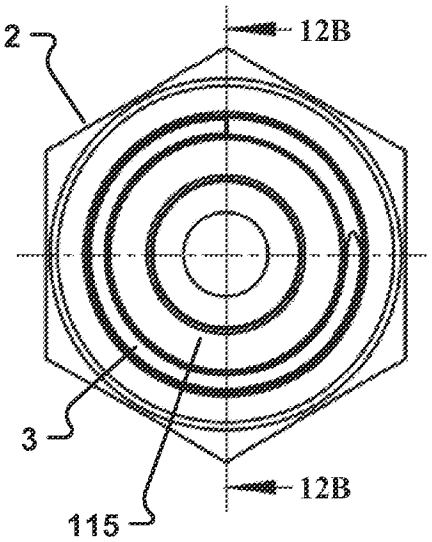
FIG. 12A is a front elevation view of a coaxial cable connector structure according to a fifth embodiment of the present invention.
Figure 12C:
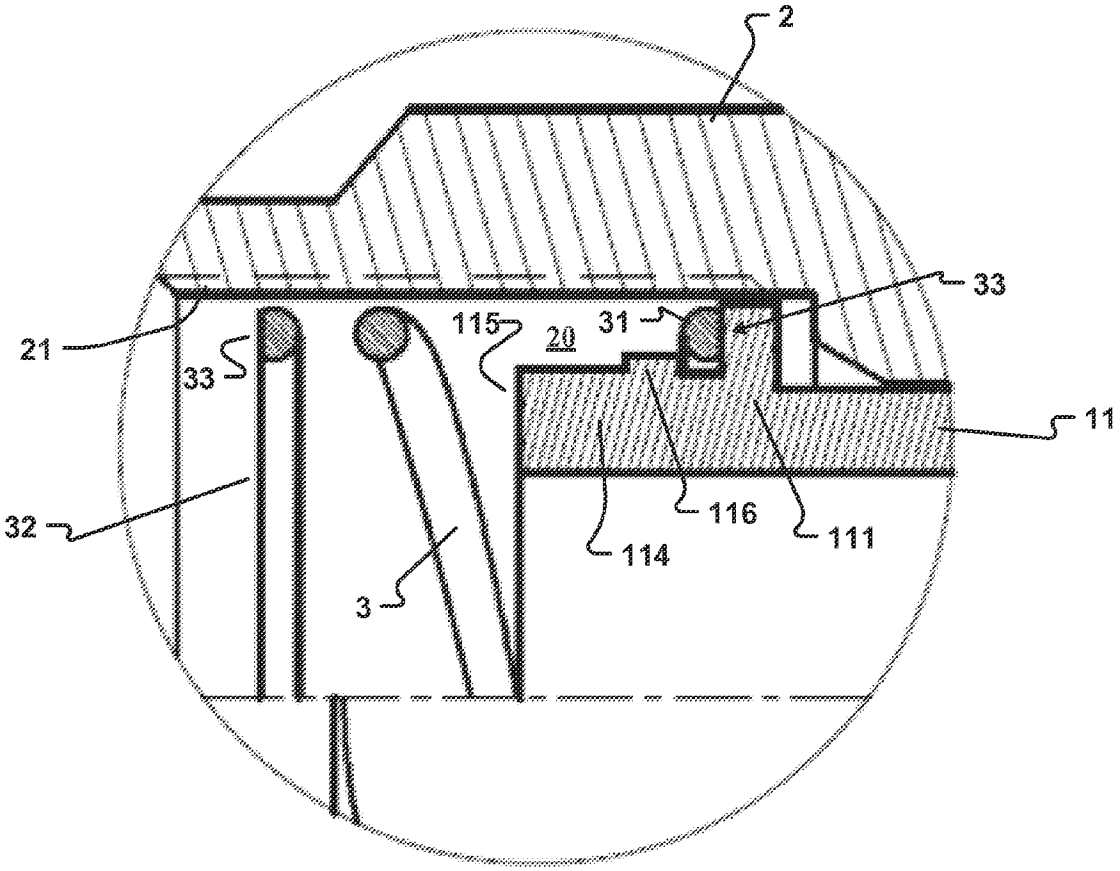
FIG. 12C is a detailed cross-sectional elevation view of a portion of the coaxial cable connector structure taken along circle 12C of FIG. 12B.

Referring now to FIGS. 12A-12C, a fifth embodiment of the coaxial cable connector structure of the present invention is illustrated. The fifth embodiment is similar to the fourth embodiment illustrated in FIGS. 11A-11C but does not include an O-ring 6 on the inner tube 11.

Figure 13B:
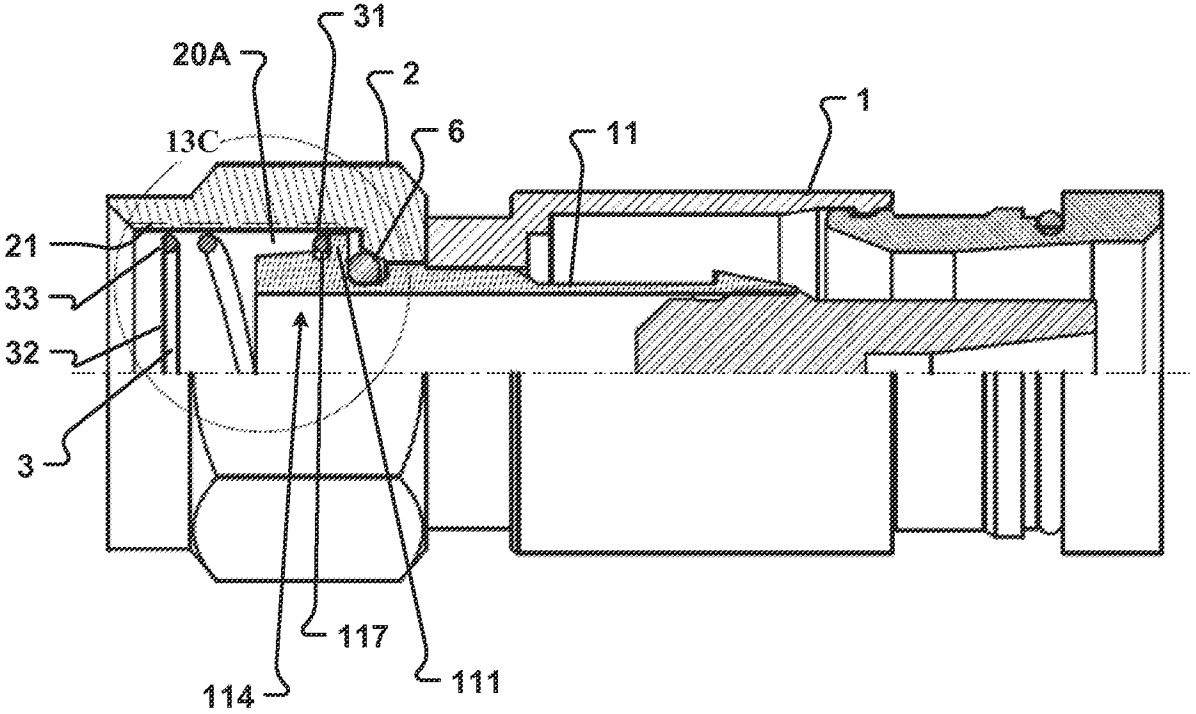
FIG. 13B is a partial cross-sectional elevation view of the coaxial cable connector structure of FIG. 13A taken along line 13B.
Figure 13A:
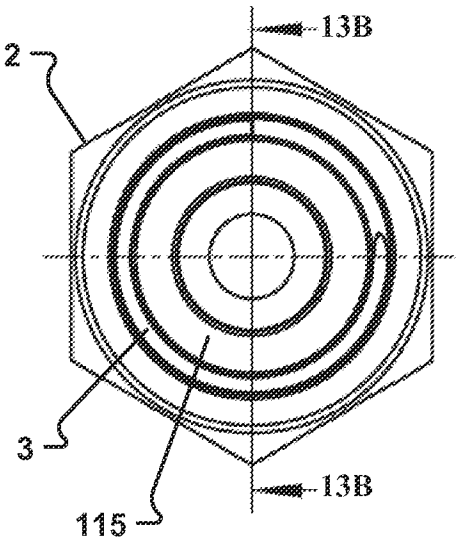
FIG. 13A is a front elevation view of a coaxial cable connector structure according to a sixth embodiment of the present invention.
Figure 13C:
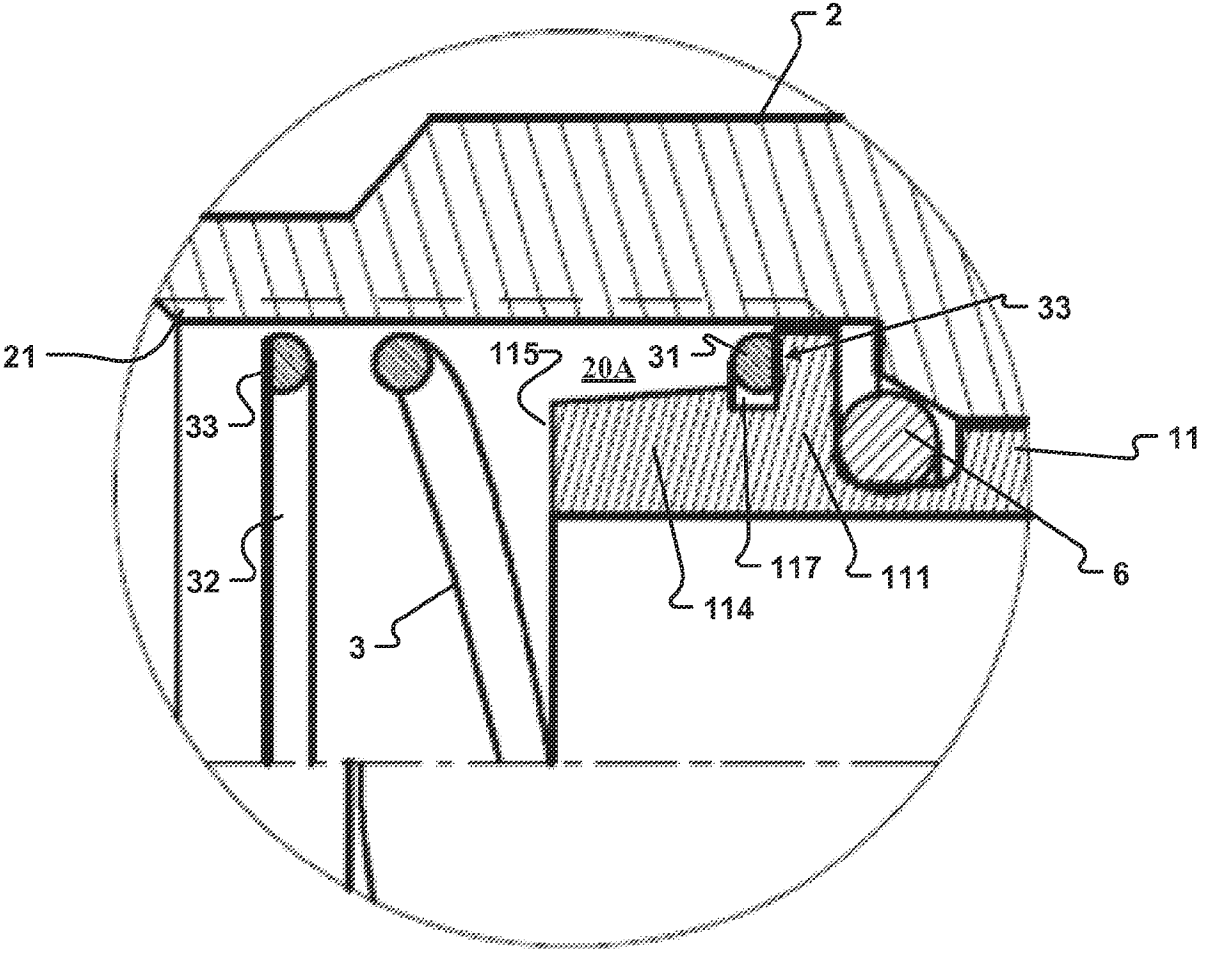
FIG. 13C is a detailed cross-sectional elevation view of a portion of the coaxial cable connector structure taken along circle 13C of FIG. 13B.

Referring now to FIGS. 13A-13C, a sixth embodiment of the coaxial cable connector structure of the present invention is illustrated. An indentation or groove 117 is formed on at least a portion of the circumference of the inner tube front portion 114. The indentation 117 is adapted to interconnect a first end 31 of the spring 3 to the inner tube 11. The indentation 117 also increases the surface contact area between the spring 3 and the inner tube 11 and improves the electrical connection between the inner tube 11 and the spring 3. In turn, this also improves the electrical connection between the connection base 5 and the inner tube 11.

In this embodiment, the outer diameter of the front portion 114 decreases from the rear end proximate the flange 111 to the forward end proximate to the front face 115. Thus, a gap 20A formed between the inner tube front portion 114 and the inner thread 21 of the annular nut 2 has a tapered cross-section that is wider at the front end than at the rear end. The tapered gap 20A improves seating or compression of the spring 3 on the front portion 114 and within the gap 20A as the annular nut 2 is screwed on the connection base 5.

Figure 13D:
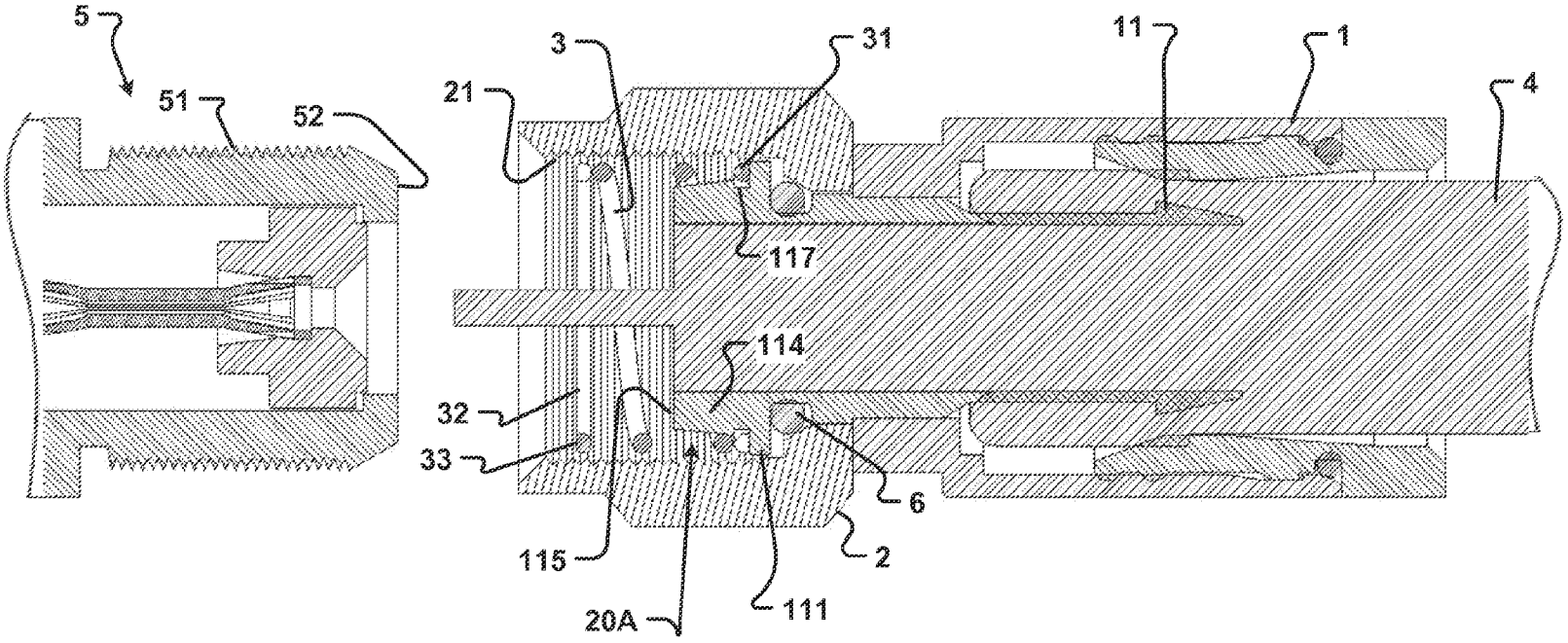
FIG. 13D is a schematic section diagram of the coaxial cable connector structure of FIG. 13A before being combined with a connection base.
Figure 13E:
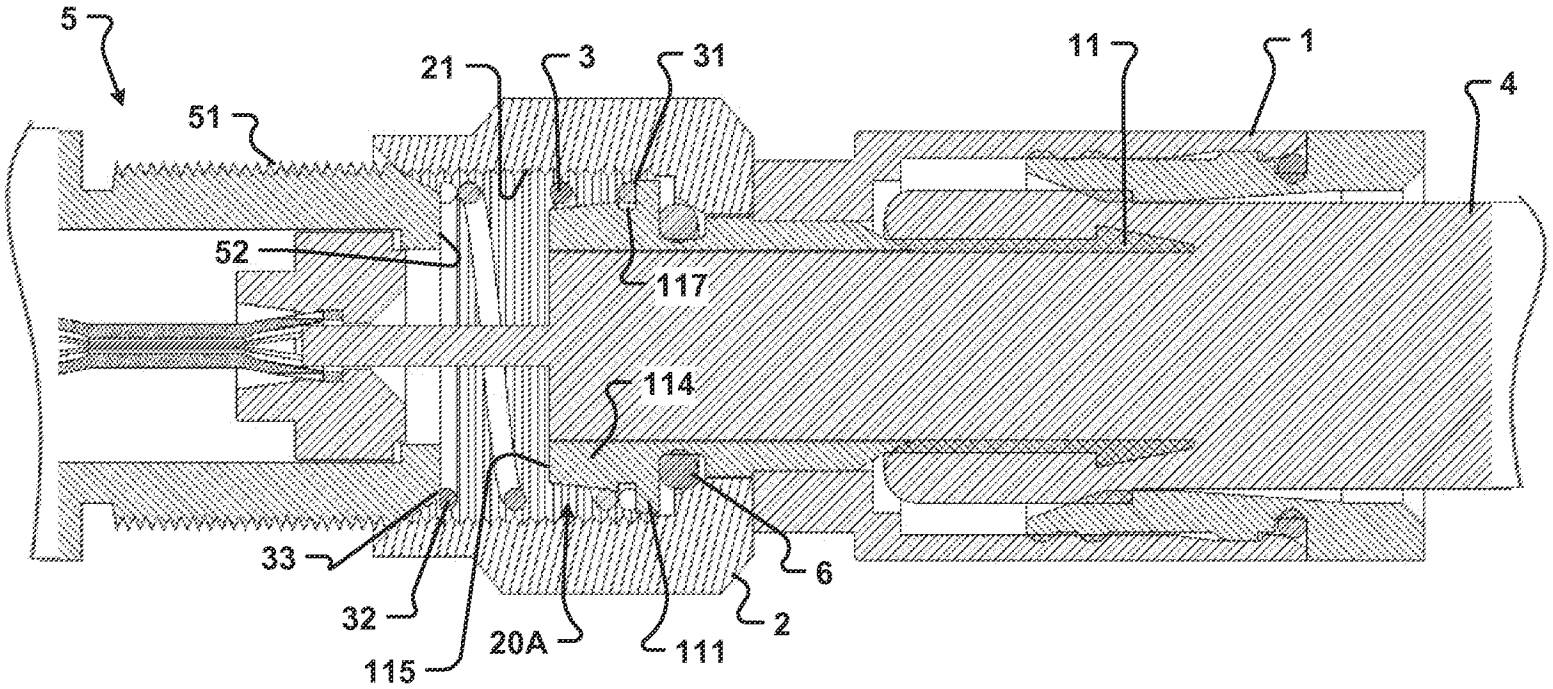
FIG. 13E is a schematic section diagram of the coaxial cable connector structure of FIG. 13A partially combined with the connection base.

In operation, and referring now to FIG. 13D, the annular nut 2 of the coaxial cable connector structure is generally aligned with the front face 52 of the connection base 5. The flat surface 33 of the second end 32 of the spring 3 faces the front face 52. Referring now to FIG. 13E, the annular nut 2 is moved toward the front face 52 bringing a least a portion of the outer thread 51 of the connection base into contact with the annular nut 2. The end surface 52 of the connection base 5 contacts at least a portion of the flat surface 33 of the second end 32 of the spring 3 and electrically connects the inner tube 11 to the connection base 5. In this manner, the spring 3 provides an electrical connection between the inner tube 11 and the connection base 5 before the annular nut 2 is rotated and before the connection base 5 is completely screwed into the inner thread 21 of the annular nut 2. Alternatively, the second end 32 of the spring 3 may be slightly recessed from that shown in FIG. 13E such that the second end 32 contacts the front face 52 only after the annular nut 2 has engaged one or a few threads of the connection base 5.

As the annular nut 2 is screwed into the connection base 5 to tighten the connection between the coaxial cable connector structure and the connection base 5, the spring 3 is compressed onto the ferrule front portion 114 between the flange 111 and the end surface 52 of the connection base 5. The spring 3 has a coil diameter predetermined to fit inside the gap 20A between the front portion 114 of the inner tube 11 and the inner thread 21 in the annular nut 2.

Figure 13F:
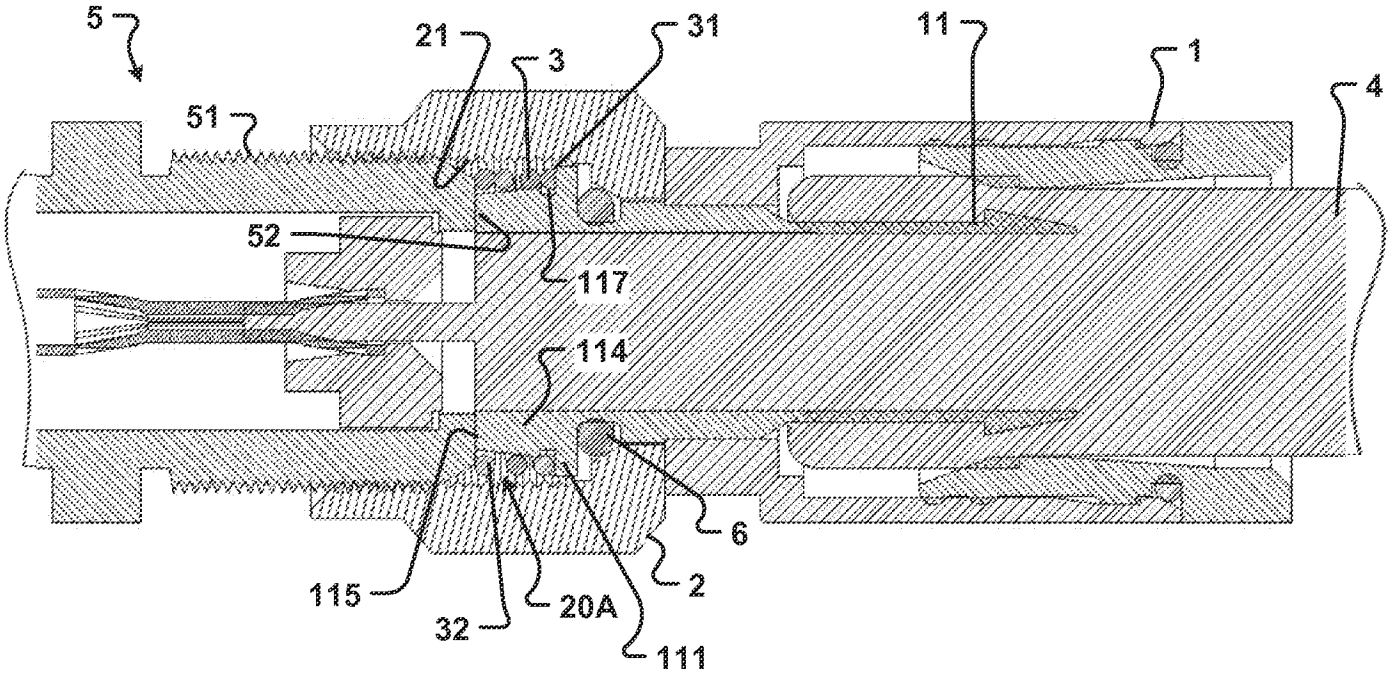
FIG. 13F is a schematic section diagram of the coaxial cable connector structure of FIG. 13A completely combined with the connection base.

As illustrated in FIG. 13F, when the annular nut 2 is fully secured to the connection base 5 the spring 3 is compressed. The spring 3 is not positioned between the end surface 52 of the connection base 5 and the front surface 115 of the inner tube 11 and does not interfere with or prevent the end surface 52 of the connection base 5 from directly contacting the front surface 115 of the inner tube 11. In this manner, the spring 3 is compressed into the gap 20A allowing full contact between the front face 115 of the inner tube 11 and the front face 52 of the connection base 5 while simultaneously maintaining contact between the second end 32 of the spring 3 and the front face 52 of the connection base 5. This improves the electrical connection between the connection base 5 and the inner tube 11. Although FIGS. 13D-13F illustrate the interconnection of a coaxial cable connector structure of the sixth embodiment to a connection base, it will be understood by those of skill in the art that substantially the same procedure is used will all embodiments of the present invention.

Figure 14B:
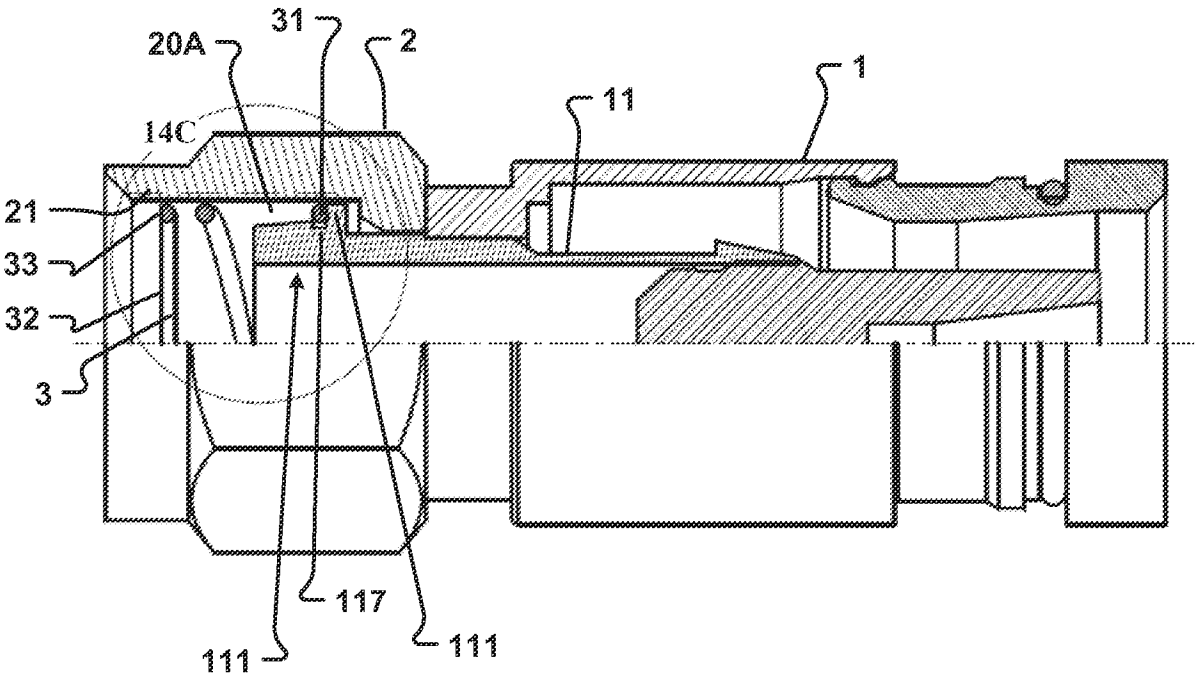
FIG. 14B is a partial cross-sectional elevation view of the coaxial cable connector structure of FIG. 14A taken along line 14B.
Figure 14A:
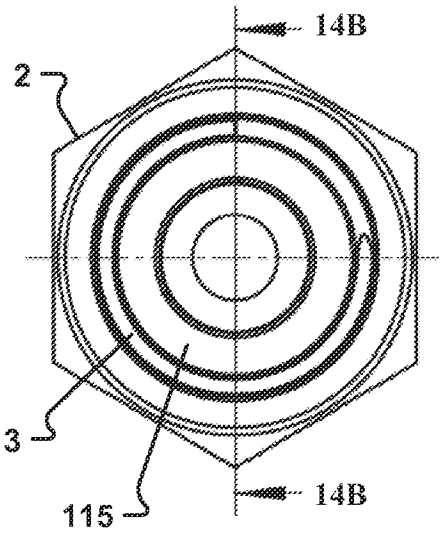
FIG. 14A is a front elevation view of a coaxial cable connector structure according to a seventh embodiment of the present invention.
Figure 14C:
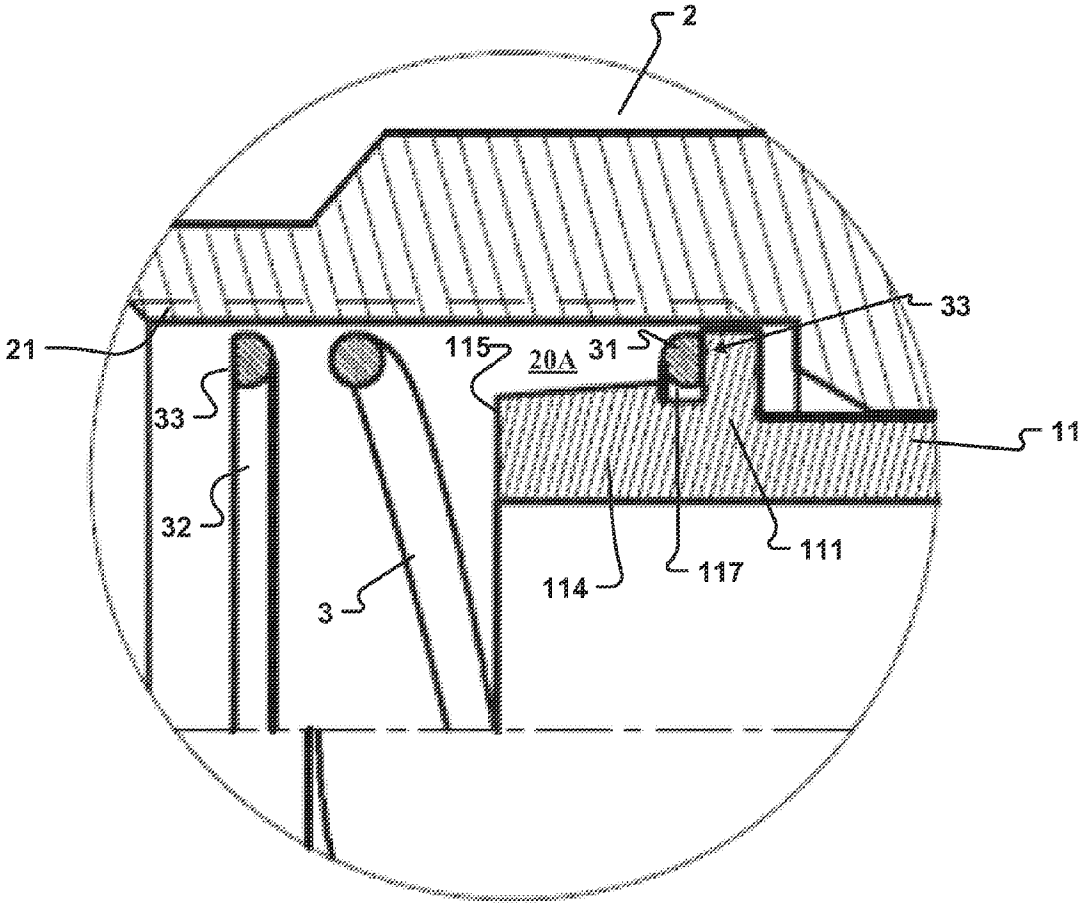
FIG. 14C is a detailed cross-sectional elevation view of a portion of the coaxial cable connector structure taken along circle 14C of FIG. 14B.

Referring now to FIGS. 14A-14C, a seventh embodiment of the coaxial cable connector structure of the present invention is illustrated. The seventh embodiment is similar to the sixth embodiment illustrated in FIGS. 13-13C and includes a tapered gap 20A but does not include an O-ring 6 on the inner tube 11.

Figure 15B:
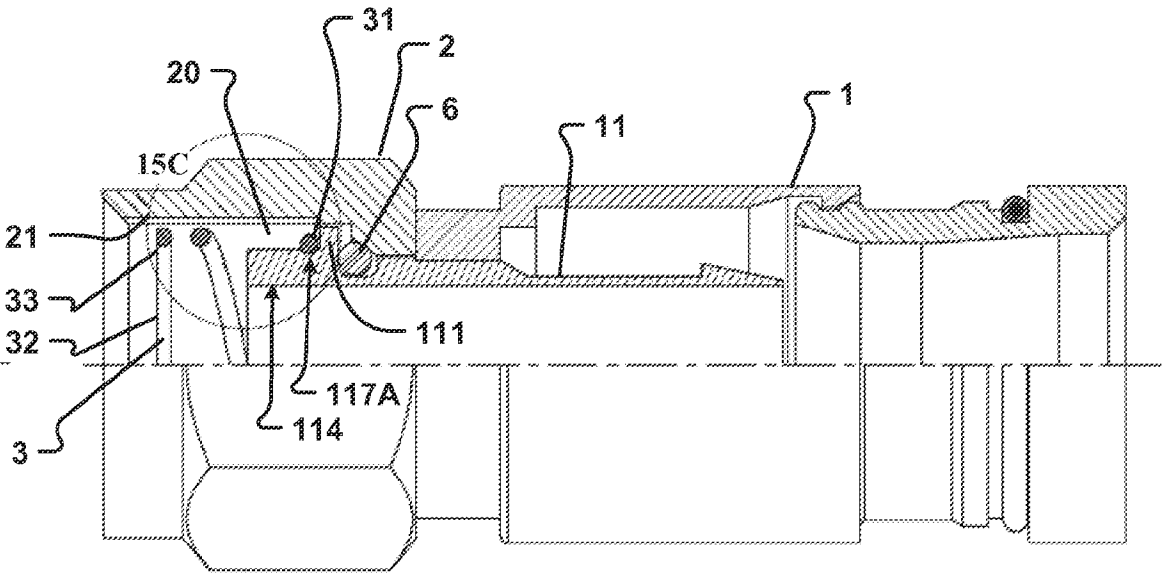
FIG. 15B is a partial cross-sectional elevation view of the coaxial cable connector structure of FIG. 15A taken along line 15B.
Figure 15A:
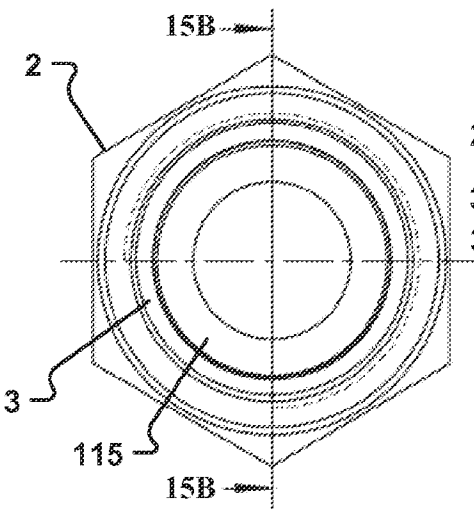
FIG. 15A is a front elevation view of a coaxial cable connector structure according to an eighth embodiment of the present invention.
Figure 15C:
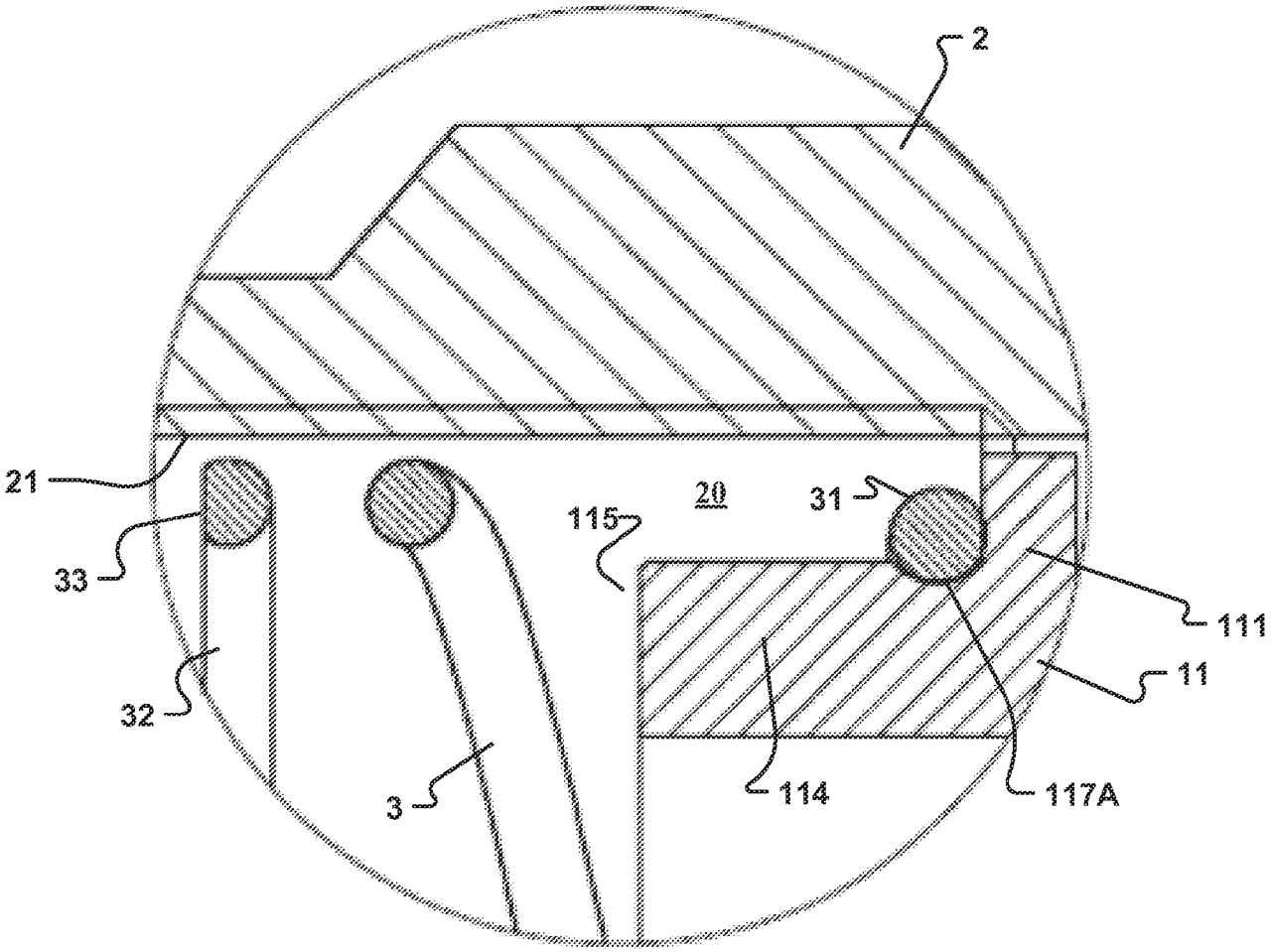
FIG. 15C is a detailed cross-sectional elevation view of a portion of the coaxial cable connector structure taken along circle 15C of FIG. 15B.

Referring now to FIGS. 15A-15C, an eighth embodiment of the coaxial cable connector structure of the present invention is illustrated. The coaxial cable connector structure includes an indentation 117A formed on at least a portion of the circumference of the front portion 114 of the inner tube 11. The indentation 117A is adapted to interconnect the spring 3 to the inner tube 11. The indentation 117A has a cross-sectional shape that is substantially equal to the surface shape of the spring 3 to increase the surface contact between the spring 3 and the inner tube 11 and improve the electrical connection between the inner tube 11 and the spring 3. In turn, this also improves the electrical connection between the connection base 5 and the inner tube 11. Although the first end 31 of the spring 3 is illustrated without a flat surface 33, it will be understood by those of skill in the art that a spring 3 with a flat surface 33 at the first end 31 may be used with the eighth embodiment of the coaxial cable connector structure illustrated in FIGS. 15A-15C.

Figure 16B:
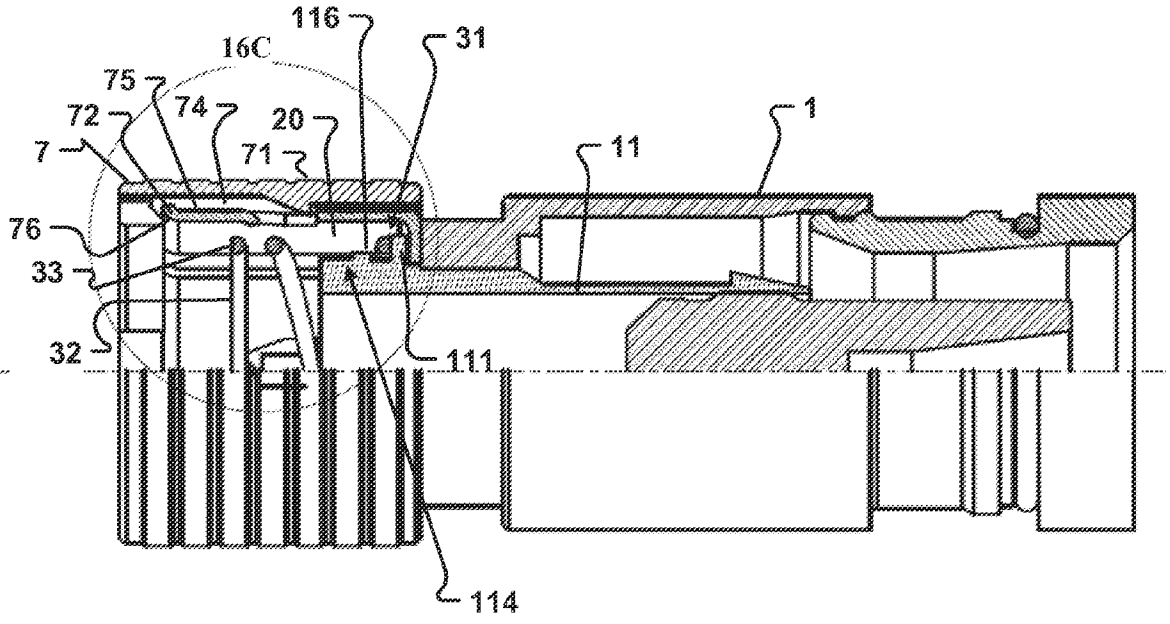
FIG. 16B is a partial cross-sectional elevation view of the coaxial cable connector structure of FIG. 16A taken along line 16B.
Figure 16A:
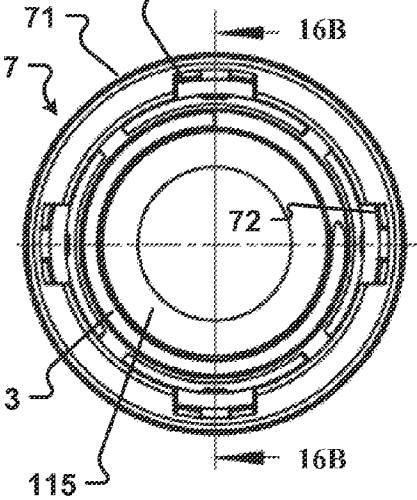
FIG. 16A is a front elevation view of a coaxial cable connector structure according to a ninth embodiment of the present invention.
Figure 16C:
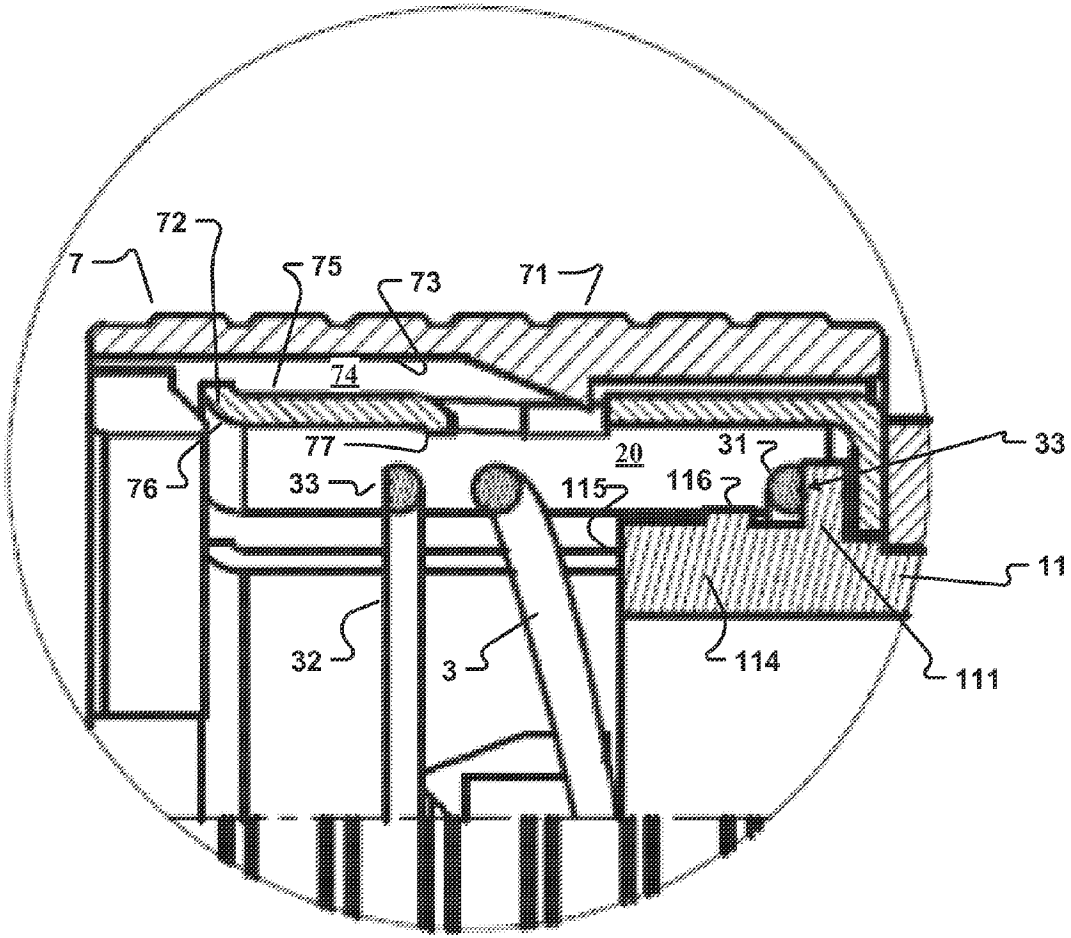
FIG. 16C is a detailed cross-sectional elevation view of a portion of the coaxial cable connector structure taken along circle 16C of FIG. 16B.

Referring now to FIGS. 16A-16C, a ninth embodiment of the coaxial cable connector structure of the present invention is illustrated. The coaxial cable connector structure includes a cylindrical structure 7. The cylindrical structure 7 fits over the outer thread 51 of a connection base 5 to frictionally interconnect the coaxial cable connector structure to the connection base 5. More specifically, as seen in FIGS. 16A-16C, the cylindrical structure 7 has an outer cylindrical body 71 and four inwardly extending tabs 72 are formed on the inner surface 73 of the cylindrical structure 7. The tabs 72 are flexible and form a gap 74 between the inner surface 73 and the outer surface 75 of the tabs 72. Each tab has a rounded front surface 76 at its leading edge. In operation, as the connection base 5 is inserted into the cylindrical structure 7, the leading edge 76 engages the outer threaded surface 51 of the connection base 5 and is deflected outwardly. The rear or tracking edge of each tab 72 has a flange or lip 77 that engages and stops the insertion of the connection base 5 and provides a seat for the connection back 5. The tabs 72 are biased inwardly to frictionally engage the outer surface 51 of the connection base 5. A gap 20 is formed between an interior diameter of a portion of the cylindrical structure 7 and the front portion 114 of the inner tube 11. A projection 116 is formed on the ferrule 114 to engage the spring 3.

Figure 17B:
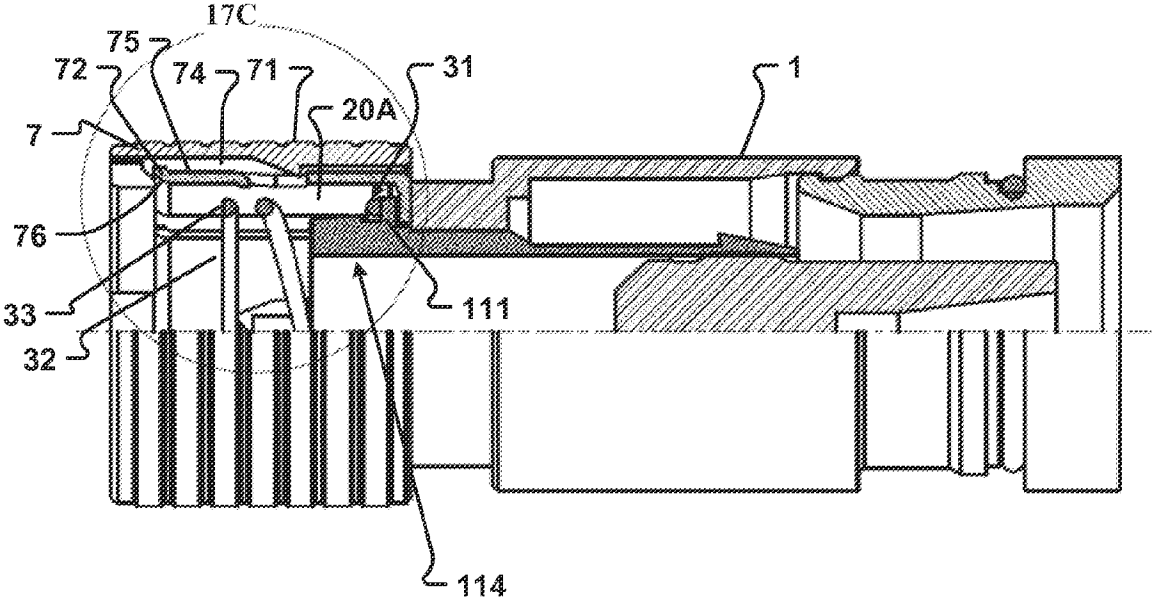
FIG. 17B is a partial cross-sectional elevation view of the coaxial cable connector structure of FIG. 17A taken along line 17B.
Figure 17A:
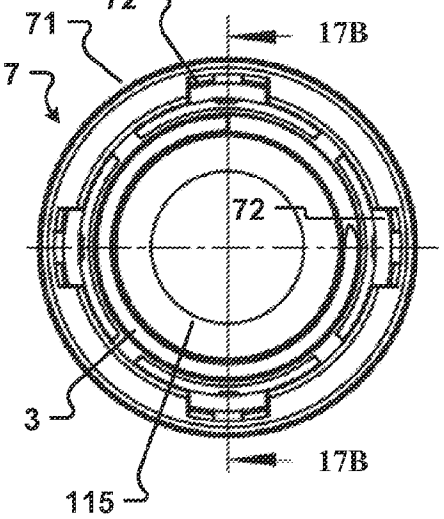
FIG. 17A is a front elevation view of a coaxial cable connector structure according to a tenth embodiment of the present invention.
Figure 17C:
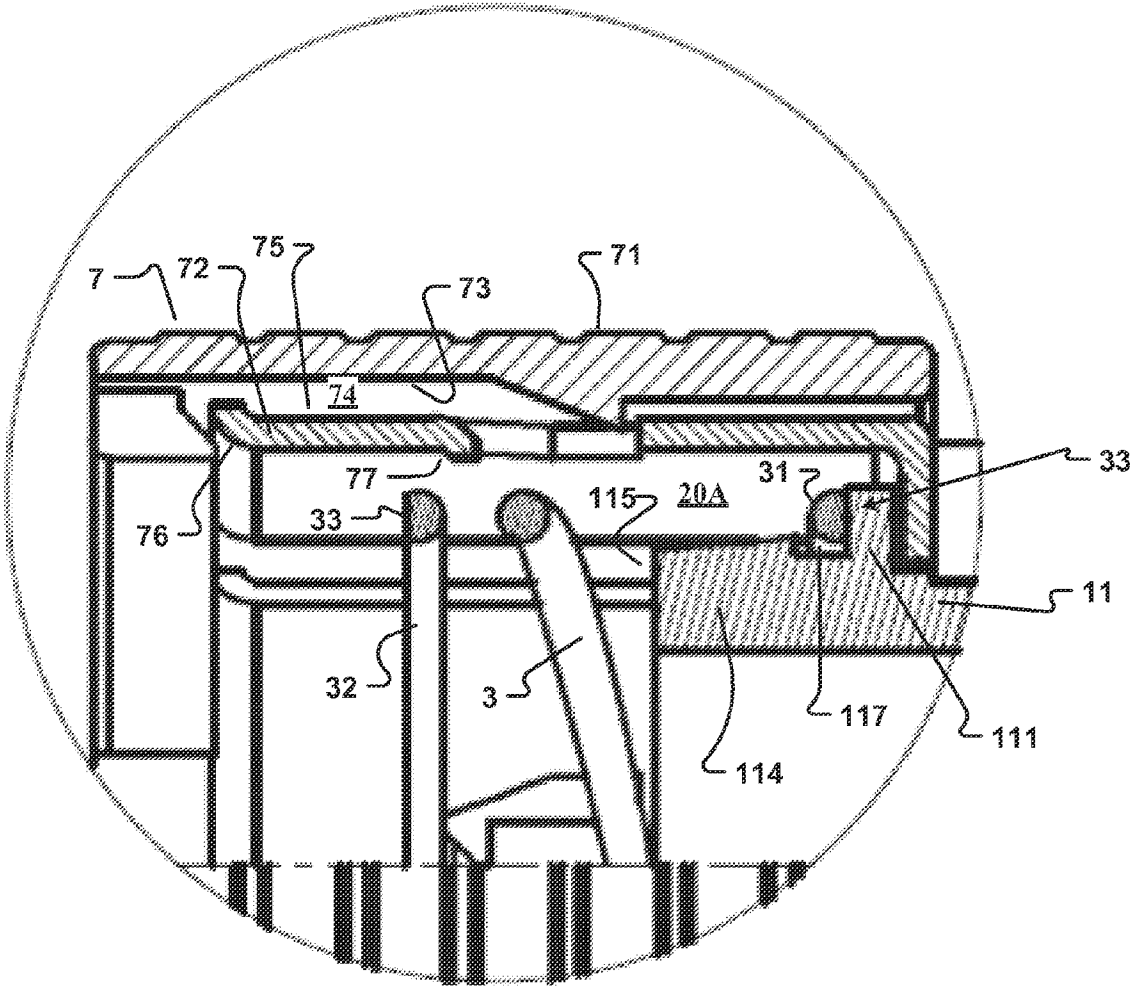
FIG. 17C is a detailed cross-sectional elevation view of a portion of the coaxial cable connector structure taken along circle 17C of FIG. 17B.

Referring now to FIGS. 17A-17C, a tenth embodiment of the coaxial cable connector structure of the present invention is illustrated. The structure is substantially the same as illustrated in FIGS. 16A-C, except the front portion 114 of the inner tube 11 is tapered.

Therefore, the present invention has the following advantages:

1. In a general installation process, the spring may be used for conducting signals of the coaxial cable when the coaxial cable connector is hard to completely screw onto the connection base, so users may conveniently operate in a narrow space, and the present invention may keep transmitting signal when the coaxial cable connector is loosened.

2. When the coaxial cable connector and the connection base are fully connected, because of elastic restoring force, two ends of the compressed spring are respectively abutted against the bottom of the coaxial cable connector and the end surface of the connection base towards the annular nut, and the spring can provide the effect of vibration suppression when the coaxial cable connector and the connection base suffer external vibration.

3. When water accidentally flows into the connection base, the present invention can maintain the transmitting of electrical signals of the coaxial cable by the O-ring disposed on the flange part of the connection base, thereby increasing the practicality significantly.

4. When the coaxial cable connector structure of embodiments of the present invention is only partially interconnected to a connector base, the electrical contact between the coaxial cable connector structure and the connector base is improved compared to known coaxial cable connectors. An improved electrical connection between the first end of the spring and the inner tube also improves the electrical connection between the connection base 5 and the inner tube 11. The outer end of the spring 32 maintains contact with the front edge of the connection base 5 from initial contact through fully seated connection providing an improved signal whether or not the connection base 5 is fully seated.

5. The coaxial cable connector structure of embodiments of the present invention does not rely on the annular nut 2 to provide electrical connection between the connector base 5 and the coaxial cable connector structure. Thus, the size and dimensions of the annular nut 2 are not critical to providing an electrical connection and do not degrade the signal if this nut is loose.

6. The annular nut 2 of embodiments of the present invention is designed to spin freely or with reduced friction compared to know nuts of coaxial cable connectors. By reducing the friction of the annular nut 2, the annular nut 2 of the present invention is easier to tighten properly and completely onto a connector base compared to a nut of other, known coaxial cable connectors.

7. By facilitating compression of the spring 3 into the gap 20 formed between the outer surface of the front portion 114 of the inner tube 11 and the inner surface of the nut 2, such as by providing a taper to the front portion 114, the spring maintains electrical connectivity between the inner tube 11 and the connection base 5 without interfering with or inhibiting a fall and complete physical connection between the front face 52 of the connection base 5 and front face 115 of the inner tube 11. The second end 32 of the spring 3 is not positioned between the front face 115 of the inner tube and the front face 52 of the connection base 5.

8. The structure of the present invention is simple and may be directly applied in the current specification of the coaxial cable connector, to increase the practicality significantly.

In summary, according to the contents disclosed above, the present invention may indeed achieve the intended purpose to provide a coaxial cable connector structure, which may transmit signals when the coaxial cable connector cannot be fastened into the connection completely or the coaxial cable connector is loosened. Thus, the present invention has industrial application and the inventor files an application for a patent according to law.

It should be understood that different modifications and variations could be made from the disclosures of the present invention by the people familiar in the art without departing the spirit of the present invention.

What is claimed is:

1. A coaxial cable connector structure, comprising:

a. a sleeve, b. an annular nut disposed on the front end of the sleeve, the annular nut having an inner thread on its inner surface for combining with a connection base having an outer thread, c. an inner tube disposed inside the sleeve for connecting the coaxial cable, the inner tube having a front end with a front surface toward the connection base, the inner tube having an outer surface of a diameter less than the diameter of the inner thread of the annular nut such that a gap is formed between the outer surface of the inner tube and the inner threads of the annular nut, d. a flange formed on the inner tube and spaced rearwardly from the front end of the inner tube, e. a coil spring having a first end and a second end, f. a retaining structure formed on the inner tube and disposed between the flange and the front end of the inner tube, g. wherein the first end of the coil spring interconnected to the retaining structure such that the first end of the coil spring is disposed within the gap and the second end of the coil spring extends forward of the front surface of the front end of the inner tube for the end surface of the connection base oriented towards the annular nut to contact and electrically connect the inner tube when the connection base is partially screwed into the inner thread of the annular nut, and when the connection base is fully screwed into the inner thread of the annular nut the end surface of the connection base will contact the front surface of the front end of the inner tube, and the coil spring will remain in contact with the end surface of the connection base and the outer surface of the inner tube.

2. The coaxial cable connector structure of claim 1, wherein the retaining structure formed on the inner tube comprises at least one of an indentation and a projection extending radially from the outer surface of the inner tube.

3. The coaxial cable connector structure of claim 2, wherein the indentation has a surface shape that substantially matches the surface shape of a potion of the coil spring.

4. The coaxial cable connector structure of claim 1, wherein the coil spring has at least one generally flat surface adapted to contact at least one of the end surface of the connection base and a surface of the flange.

5. The coaxial cable connector structure of claim 4, wherein the at least one generally flat surface is formed along a chord of the coil spring.

6. The coaxial cable connector structure of claim 4, wherein the at least one generally flat surface is formed along a diameter of the coil spring.

7. The coaxial cable connector structure of claim 4, wherein the coil spring has a substantially uniform cross-sectional shape along a length of the coil spring.

8. The coaxial cable connector structure of claim 1, wherein at least one winding of the coil spring has an inner diameter that is less than the diameter of the outer surface of the inner tube.

9. The coaxial cable connector structure of claim 1, wherein a diameter of the outer surface of the inner tube proximate the flange is greater than a diameter of the outer surface of front end of the inner tube such that a tapered gap is formed between the outer surface of the inner tube and the inner threads of the annular nut.

10. The coaxial cable connector structure of claim 1, wherein the coil spring engages the inner thread of the annual nut.

11. The coaxial cable connector structure of claim 1, wherein the entire spring is disposed within the gap when the inner thread of the annular nut is fully screwed onto the connection base.

12. The coaxial cable connector structure of claim 1, wherein the annular nut further comprises a bottom end and the first end of the coil spring engages the bottom end of the nut to dampen vibration of the annular nut.

13. A method of electrically connecting a coaxial cable to a connection base with a coaxial cable connector structure, comprising:

a. providing an coaxial cable connector structure comprising:
   i. a sleeve;
   ii. an annular nut disposed on the front end of the sleeve, the annular nut having an inner thread on its inner surface;
   iii. an inner tube disposed inside the sleeve, the inner tube having a front end with a front surface toward the connection base, a flange spaced rearwardly from the front end of the inner tube, the inner tube having an outer surface of a diameter less than a diameter of the inner thread of the annular nut such that a gap is formed between the outer surface of the inner tube and the inner threads of the annular nut;
   iv. a retaining structure formed on the inner tube forward of the flange,
   v. a coil spring having a first end interconnected to the retaining structure and a second end extending forward of the front end of the inner tube, the coil spring having at least one generally flat surface adapted to contact at least one of the end surface of the connection base and a surface of the flange;
b. interconnecting the coaxial cable to the sleeve of the coaxial cable connector structure;
c. placing the annular nut in contact with an outer thread of the connection base;
d. rotating the annular nut to at least partially screw the connection base into the inner thread of the annular nut, wherein the second end of the coil spring contacts at least a portion of the end surface of the connection base and electrically connects the inner tube to the connection base; and
e. rotating the annular nut to fully screw the connection base into the inner thread of the annular nut, wherein the end surface of the connection base contacts the front surface of the front end of the inner tube, and wherein the coil spring is compressed in the gap and the second end contacts the end surface of the connection base and the first end contacts the outer surface of the inner tube.

* * * * *